US010234789B2

(12) United States Patent
Kawano et al.

(10) Patent No.: US 10,234,789 B2
(45) Date of Patent: Mar. 19, 2019

(54) IMAGE FORMING APPARATUS

(71) Applicant: KYOCERA Document Solutions Inc., Osaka-shi (JP)

(72) Inventors: Daichi Kawano, Osaka (JP); Takahisa Nakaue, Osaka (JP); Koichi Hayashi, Osaka (JP); Daisuke Eto, Osaka (JP); Riku Minamoto, Osaka (JP); Sadanori Nakae, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/050,121

(22) Filed: Jul. 31, 2018

(65) Prior Publication Data

US 2019/0041770 A1 Feb. 7, 2019

(30) Foreign Application Priority Data

Aug. 7, 2017 (JP) ..... 2017-152363

(51) Int. Cl.
*G03G 15/01* (2006.01)
*G03G 15/08* (2006.01)

(52) U.S. Cl.
CPC ..... *G03G 15/0856* (2013.01); *G03G 15/0865* (2013.01); *G03G 15/0121* (2013.01); *G03G 15/0822* (2013.01); *G03G 15/0849* (2013.01); *G03G 15/0868* (2013.01); *G03G 15/0875* (2013.01); *G03G 15/0877* (2013.01); *G03G 15/0879* (2013.01); *G03G 15/0891* (2013.01)

(58) Field of Classification Search
CPC ..... G03G 15/0121; G03G 15/0822; G03G 15/0849; G03G 15/0856; G03G 15/0865; G03G 15/0868; G03G 15/0875; G03G 15/0877; G03G 15/0879; G03G 15/0891
See application file for complete search history.

(56) References Cited

U.S. PATENT DOCUMENTS

2015/0185659 A1* 7/2015 Konishi ..... G03G 15/0865 399/262
2015/0185663 A1* 7/2015 Nakamura ..... G03G 15/0877 399/262
2016/0054681 A1* 2/2016 Eto ..... G03G 15/0867 399/262

FOREIGN PATENT DOCUMENTS

JP 2015-127789 7/2015

* cited by examiner

*Primary Examiner* — Joseph S Wong
(74) *Attorney, Agent, or Firm* — Gerald E. Hespos; Michael J. Porco; Matthew T. Hespos

(57) ABSTRACT

An image forming apparatus includes a developer container having a movable wall therein, a determination unit, a movable wall driving unit, and a movable wall driving controller. The determination unit outputs first determination information when a number of outputs of a signal indicating that a detection sensor has detected a developer is less than a threshold value, and outputs second determination information when the number of outputs thereof is equal to or greater than the threshold value. The movable wall driving unit includes a first driving motor for moving the movable wall and a first driving circuit for controlling driving thereof. The movable wall driving controller includes a signal controller. The signal controller transmits a drive permission signal for the first driving motor when the first determination information is output, and transmits a drive non-permission signal for the first driving motor when the second determination information is output.

4 Claims, 28 Drawing Sheets

IMAGE FORMING APPARATUS

INCORPORATION BY REFERENCE

This application is based on Japanese Patent Application No. 2017-152363 filed on Aug. 7, 2017 to the Japan Patent Office, the contents of which are incorporated by reference.

BACKGROUND

The present disclosure relates to an image forming apparatus including a developer container for containing a developer.

Conventionally, as an image forming apparatus that forms an image on a sheet, there is known an image forming apparatus including a sheet conveying unit that conveys a sheet, an image carrier that carries a developer image transferred to the sheet, a developing device that supplies a developer to the image carrier, and a developer container that contains the developer to be replenished to the developing device.

As a prior art, there is a developer container having a movable wall that conveys a developer toward a developer discharge port by moving the developer along a shaft in an internal space where the developer is contained. In this technique, a detection sensor detects that an amount of the developer contained in the internal space decreases with replenishment to the developing device, and the movable wall is moved according to an output signal of the detection sensor.

SUMMARY

An image forming apparatus according to one aspect of the present disclosure includes a developing device, a developer container, a detection sensor, a determination unit, a movable wall driving unit, and a movable wall driving controller.

The developer container is detachably mounted to the developing device, and includes a container main body, a movable wall, and a rotating body. The container main body has an internal space which extends in a first direction and contains a developer, and is formed with a developer discharge port through which the developer is discharged toward the developing device. The movable wall moves in the first direction in the internal space to convey the developer in the internal space toward the developer discharge port. The rotating body is disposed near the developer discharge port in the internal space and rotates around a shaft extending in the first direction.

The detection sensor is disposed so as to face the container main body, and detects the developer. In a plurality of output signals output from the detection sensor at predetermined time intervals during one cycle which is one rotation of the rotating body, the determination unit determines whether or not a number of outputs of a signal indicating that the developer has been detected is less than a reference threshold value. The determination unit outputs first determination information when the number of outputs is less than the reference threshold value and outputs second determination information when the number of outputs is equal to or greater than the reference threshold value. The movable wall driving unit includes a first driving motor that generates a driving force for moving the movable wall and a first driving circuit that controls driving of the first driving motor. The movable wall driving controller is communicably connected to the first driving circuit and includes a signal controller for transmitting a control signal related to drive control of the first driving motor to the first driving circuit.

The signal controller transmits a drive permission signal, which is a control signal for permitting drive control of the first driving motor, when the first determination information is output from the determination unit, and transmits a drive non-permission signal, which is a control signal for not permitting drive control of the first driving motor, when the second determination information is output from the determination unit.

DETAILED DESCRIPTION

Figure 1:
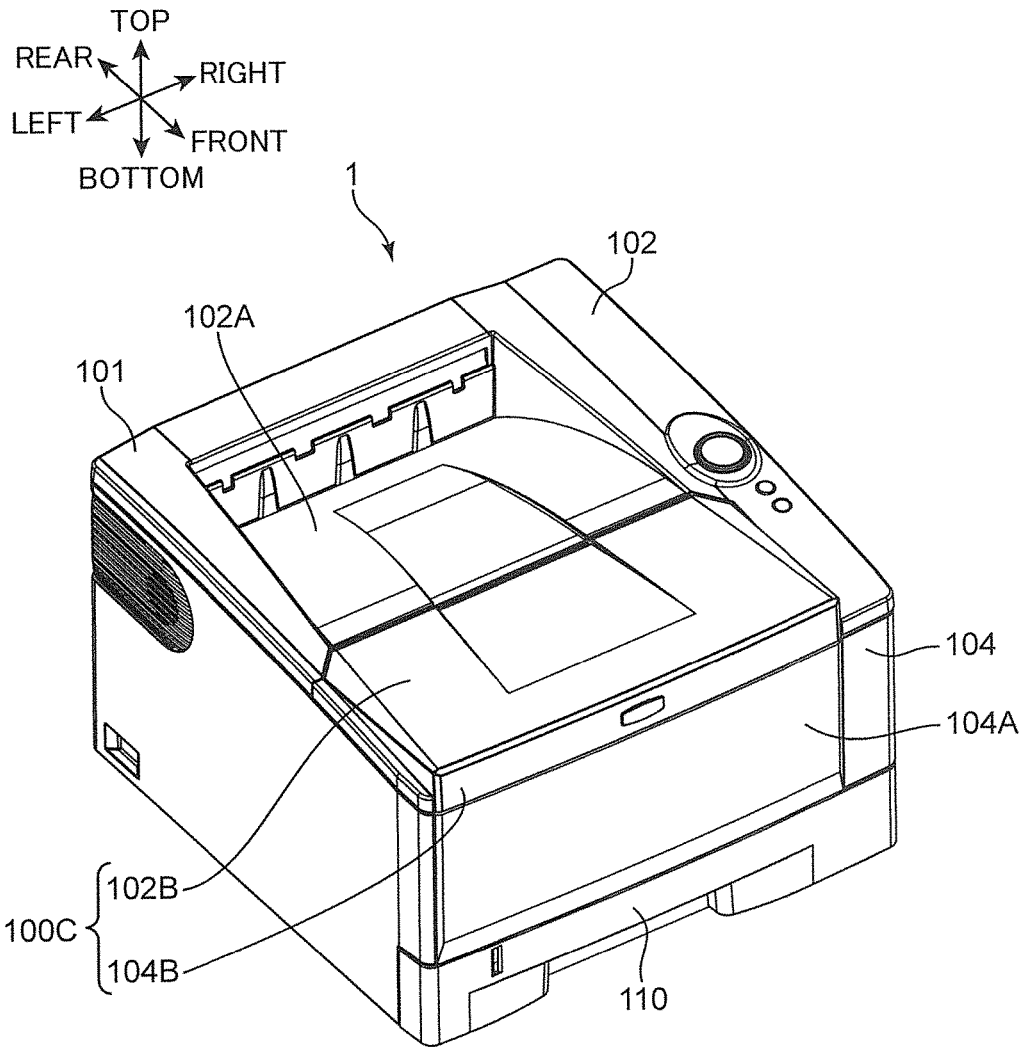
FIG. 1 is a perspective view showing an image forming apparatus according to an embodiment of the present disclosure.
Figure 2:
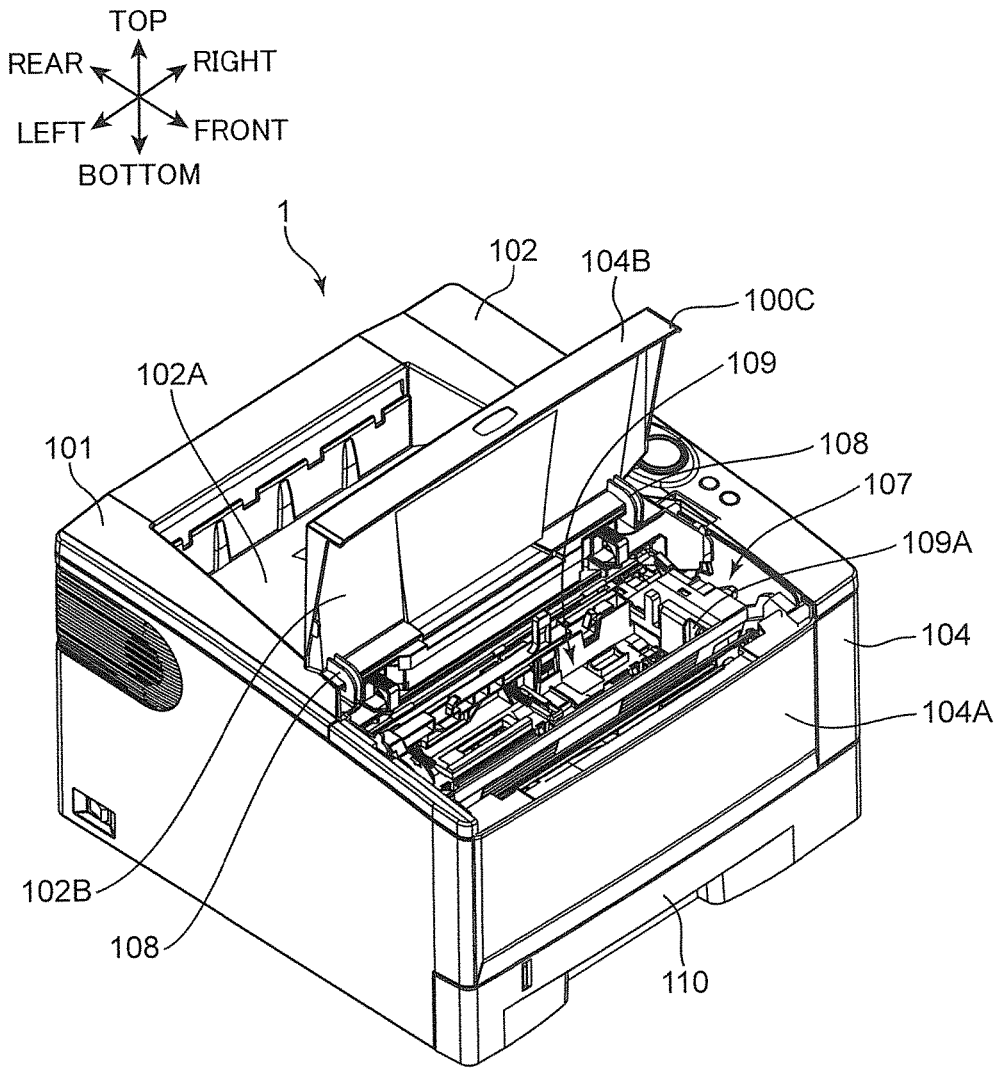
FIG. 2 is a perspective view showing a state in which a part of a housing of the image forming apparatus is opened.
Figure 3:
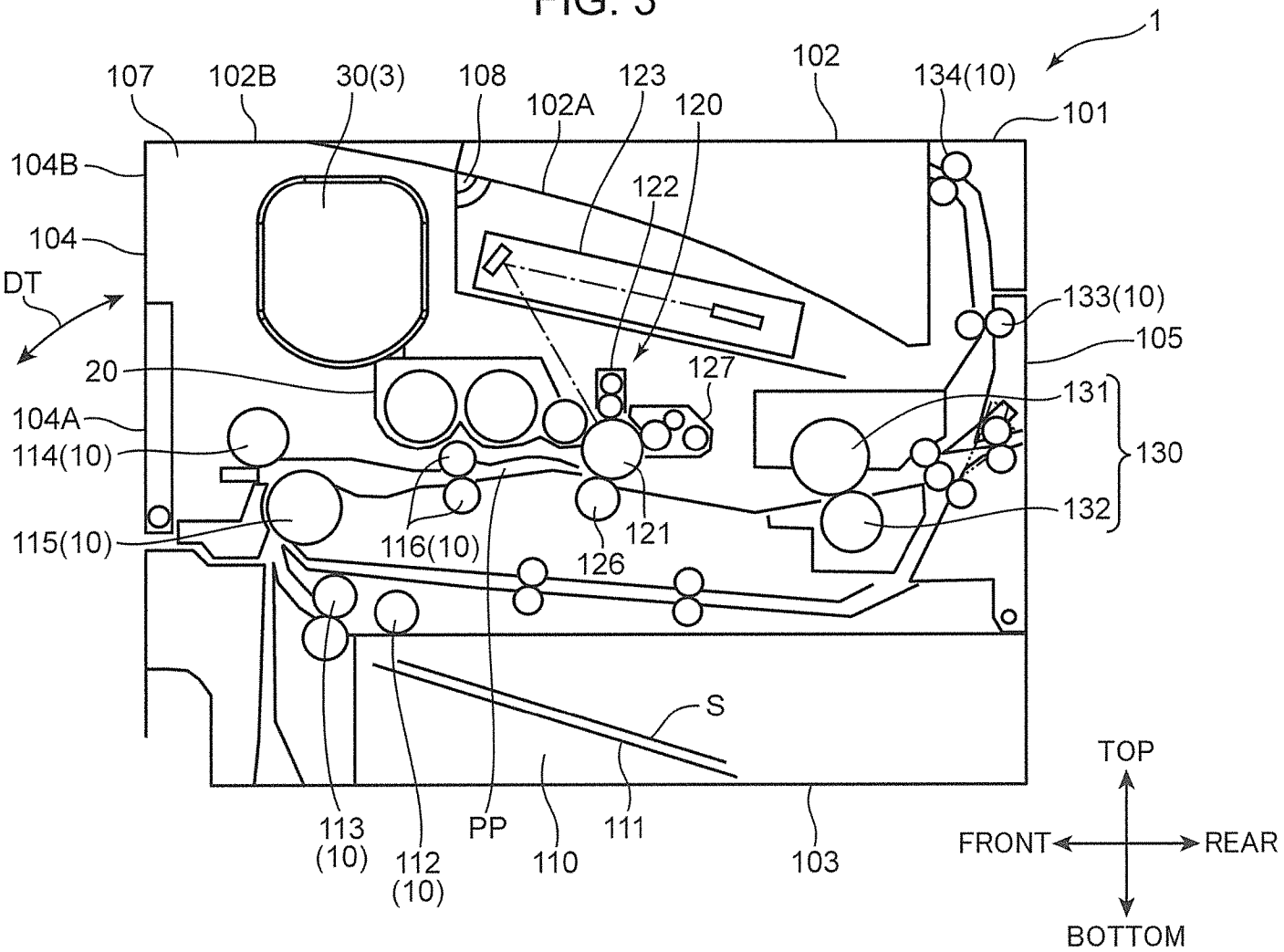
FIG. 3 is a cross-sectional view schematically showing an internal structure of the image forming apparatus.

Hereinafter, an image forming apparatus according to an embodiment of the present disclosure will be described with reference to the drawings. FIGS. 1 and 2 are perspective views of an image forming apparatus 1 according to the embodiment of the present disclosure. FIG. 3 is a cross-sectional view schematically showing an internal structure of the image forming apparatus 1 shown in FIGS. 1 and 2. The image forming apparatus 1 shown in FIGS. 1 to 3 is a so-called monochrome printer, but in another embodiment, the image forming apparatus 1 may be a color printer, a facsimile machine, a multifunction machine having these functions, or another device for forming a toner image on a sheet. It should be noted that the terms "top", "bottom", "front", "rear", "left" and "right" indicating directions, used in the following description are merely intended to clarify the explanation, and are not intended to limit the principle of the image forming apparatus 1 at all.

<Overall Configuration of Image Forming Apparatus>

The image forming apparatus 1 includes a housing 101 that houses various devices for forming an image on a sheet S. The housing 101 has a top wall 102 that defines a top surface of the housing 101, a bottom wall 103 (FIG. 3) that defines a bottom surface of the housing 101, a main body rear wall 105 (FIG. 3) that is between the top wall 102 and the bottom wall 103, and a main body front wall 104 located in front of the main body rear wall 105. The housing 101 includes a main body internal space 107 in which various devices are disposed. A sheet conveyance passage PP through which the sheet S is conveyed in a predetermined conveying direction extends in the main body internal space 107 of the housing 101. Further, the image forming apparatus 1 includes an opening/closing cover 100C that is attached to the housing 101 so as to freely open and close.

The opening/closing cover 100C is composed of a front wall upper portion 104B which is an upper portion of the main body front wall 104 and a top wall front portion 102B which is a front portion of the top wall 102. Further, the opening/closing cover 100C can be opened and closed in a vertical direction with hinge shafts (not shown) acting as a fulcrum. The hinge shafts are respectively disposed on a pair of arms 108 disposed at both ends in a left and right direction (FIG. 2). In an open state of the opening/closing cover 100C, an upper part of the main body internal space 107 is opened to the outside. On the other hand, in a closed state of the opening/closing cover 100C, the upper part of the main body internal space 107 is closed.

A sheet discharge portion 102A is disposed at a center of the top wall 102. The sheet discharge portion 102A is formed by an inclined surface inclined downward from the front portion to a rear portion of the top wall 102. The sheet S, on which an image has been formed in an image forming unit 120 described later, is discharged to the sheet discharge portion 102A. A manual feed tray 104A is disposed in a center of the main body front wall 104 in the vertical direction. The manual feed tray 104A is rotatable up and down with a lower end of the manual feed tray 104A acting as a fulcrum (arrow DT in FIG. 3).

Referring to FIG. 3, the image forming apparatus 1 includes a sheet conveying unit 10, the image forming unit 120, and a fixing device 130. The sheet conveying unit 10 is a mechanism for conveying the sheet S from a cassette 110 to the sheet discharge portion 102A via the image forming unit 120 and the fixing device 130. The sheet conveying unit 10 includes a pickup roller 112, a first sheet feeding roller 113, a second sheet feeding roller 114, a conveying roller 115, and a registration roller pair 116 disposed on an upstream side in a sheet conveying direction with respect to the image forming unit 120, and a conveying roller pair 133 and a discharge roller pair 134 disposed on a downstream side in the sheet conveying direction with respect to the fixing device 130.

The cassette 110 contains the sheet S therein. The cassette 110 includes a lift plate 111. The lift plate 111 is inclined so as to push up a leading edge of the sheet S. The cassette 110 can be withdrawn forward from the housing 101.

The pickup roller 112 is disposed on the leading edge of the sheet S pushed up by the lift plate 111. When the pickup roller 112 rotates, the sheet S is pulled out from the cassette 110.

The first sheet feeding roller 113 is disposed downstream of the pickup roller 112, and feeds the sheet S further downstream. The second sheet feeding roller 114 is disposed on an inner side (a rear side) of the fulcrum of the manual feed tray 104A, and pulls the sheet S on the manual feed tray 104A into the housing 101.

The conveying roller 115 is disposed downstream of the first sheet feeding roller 113 and the second sheet feeding roller 114 in the sheet conveying direction. The conveying roller 115 conveys the sheet S delivered by the first sheet feeding roller 113 and the second sheet feeding roller 114 further downstream.

The registration roller pair 116 has a function of correcting oblique conveyance of the sheet S. As a result, a position of the image formed on the sheet S is adjusted. The registration roller pair 116 supplies the sheet S to the image forming unit 120 in accordance with timing of image formation by the image forming unit 120.

The sheet S after a fixing process by the fixing device 130 is conveyed upward by the conveying roller pair 133 and finally discharged from the housing 101 by the discharge roller pair 134. The sheets S discharged from the housing 101 are stacked on the sheet discharge portion 102A.

The image forming unit 120 includes a photosensitive drum 121 (an image carrier), a charger 122, an exposure device 123, a developing device 20, a toner supply device 3, a transfer roller 126, and a cleaning device 127.

The photosensitive drum 121 has a cylindrical shape. The photosensitive drum 121 has a surface on which an electrostatic latent image is formed and also carries a toner image (a developer image) corresponding to the electrostatic latent image on the surface. A predetermined voltage is applied to the charger 122 to charge the surface of the photosensitive drum 121 substantially uniformly.

The exposure device 123 irradiates the surface of the photosensitive drum 121 charged by the charger 122 with laser light. As a result, an electrostatic latent image corresponding to image data is formed on the surface of the photosensitive drum 121.

The developing device 20 supplies a toner (a developer) to the surface of the photosensitive drum 121 on which the electrostatic latent image is formed. The toner supply device 3 supplies a toner to the developing device 20. When the developing device 20 supplies the toner to the photosensitive drum 121, the electrostatic latent image formed on the surface of the photosensitive drum 121 is developed (visualized). As a result, a toner image (a developer image) is formed on the surface of the photosensitive drum 121.

The transfer roller 126 is disposed below the photosensitive drum 121 so as to face the photosensitive drum 121 across the sheet conveyance passage PP. The transfer roller 126 forms a transfer nip with the photosensitive drum 121, and transfers the toner image to the sheet S.

After the toner image is transferred to the sheet S, the cleaning device 127 removes the toner remaining on the surface of the photosensitive drum 121.

The fixing device 130 is disposed on the downstream side in the sheet conveying direction of the image forming unit 120 and fixes the toner image on the sheet S. The fixing device 130 includes a heating roller 131 for melting the toner on the sheet S and a pressure roller 132 for bringing the sheet S into close contact with the heating roller 131.

<About Developing Device>

Figure 4:
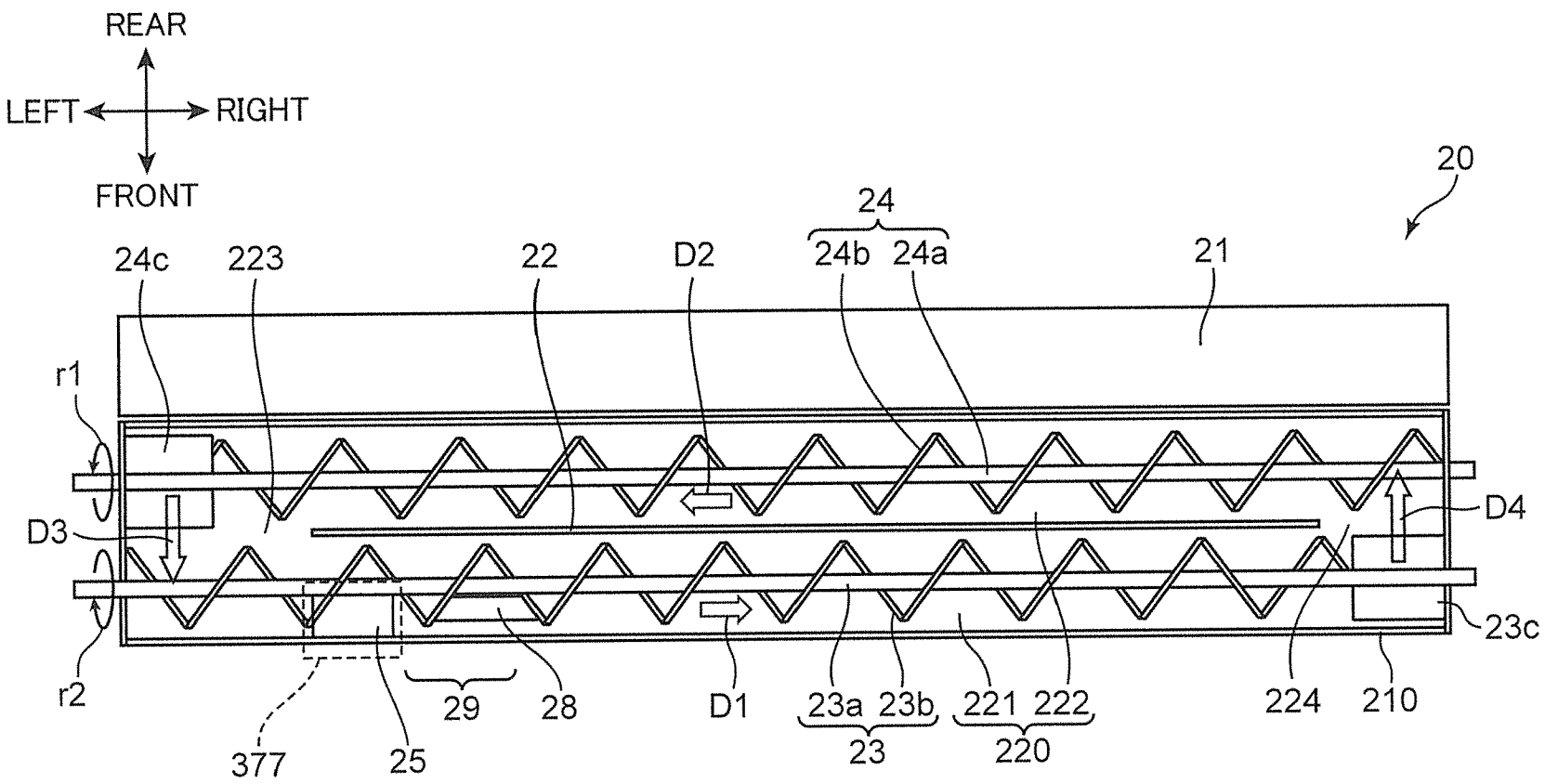
FIG. 4 is a plan view schematically showing an internal structure of a developing device provided in the image forming apparatus.

FIG. 4 is a plan view showing an internal structure of the developing device 20. The developing device 20 includes a development housing 210 having a long box shape in one direction (an axial direction, a left and right direction of a developing roller 21). The development housing 210 has a storage space 220. In the storage space 220, the developing roller 21, a first stirring screw 23, a second stirring screw 24, and a toner supply port 25 are disposed. In the present embodiment, one-component developing method is applied, and the storage space 220 is filled with a magnetic toner as a developer. On the other hand, in a case of a two-component developing method, a mixture of a toner and a carrier made of a magnetic material is filled as a developer. The toner is stirred and conveyed in the storage space 220, and is sequentially supplied from the developing roller 21 to the photosensitive drum 121 in order to develop an electrostatic latent image.

The developing roller 21 has a cylindrical shape extending in a longitudinal direction of the development housing 210, and has a sleeve rotatably driven on an outer periphery. The storage space 220 of the development housing 210 is covered with a top plate (not shown) and is partitioned into a first conveyance passage 221 and a second conveyance passage 222 elongated in the left and right direction by a partition plate 22 extending in the left and right direction. The partition plate 22 is shorter than a width in the left and right direction of the development housing 210, and a first communication passage 223 and a second communication passage 224 for communicating the first conveyance passage 221 and the second conveyance passage 222 are respectively provided at a left end and a right end of the partition plate 22. As a result, in the storage space 220, a circulation path including the first conveyance passage 221, the second communication passage 224, the second conveyance passage 222, and the first communication passage 223 is formed. The toner is conveyed counterclockwise in the circulation path in FIG. 4.

The toner supply port 25 is an opening that is opened in the top plate of the development housing 210 and is disposed above a vicinity of a left end of the first conveyance passage 221. The toner supply port 25 is disposed opposite to the above circulation path and supplies a replenishment toner supplied from a toner discharge port 377 (FIG. 4) of a toner container 30 (a developer container) in the toner supply device 3 to the storage space 220.

The first stirring screw 23 is disposed in the first conveyance passage 221. The first stirring screw 23 includes a first rotary shaft 23*a* and a first spiral blade 23*b* protruding in a spiral shape on a circumference of this first rotary shaft 23*a*. The first stirring screw 23 is driven to rotate around the first rotary shaft 23*a* (arrow r2) to convey the toner in an arrow D1 direction in FIG. 4. The first stirring screw 23 conveys the toner so that the toner supply port 25 passes through a position opposed to the first conveyance passage 221. As a result, the first stirring screw 23 has a function of mixing and conveying a new toner flowing in through the toner supply port 25 and a toner carried in the first conveyance passage 221 from the second conveyance passage 222. A first paddle 23*c* is disposed on a downstream side of the first stirring screw 23 in a toner conveying direction (the D1 direction). The first paddle 23*c* is rotated together with the first rotary shaft 23*a* and delivers the toner from the first conveyance passage 221 to the second conveyance passage 222 in an arrow D4 direction in FIG. 4.

The second stirring screw 24 is disposed in the second conveyance passage 222. The second stirring screw 24 includes a second rotary shaft 24*a* and a second spiral blade 24*b* protruding in a spiral shape on a circumference of this second rotary shaft 24*a*. The second stirring screw 24 is driven to rotate around the second rotary shaft 24*a* (arrow r1) to supply the toner to the developing roller 21 while conveying the toner in an arrow D2 direction in FIG. 4. A second paddle 24*c* is disposed downstream of the second stirring screw 24 in the toner conveying direction (the D2 direction). The second paddle 24*c* is rotated together with the second rotary shaft 24*a* and delivers the toner from the second conveyance passage 222 to the first conveyance passage 221 in an arrow D3 direction in FIG. 4.

The toner supply device 3 includes the toner container 30 (the developer container) disposed above the toner supply port 25 of the development housing 210. The toner container 30 has the toner discharge port 377 (a developer discharge port, FIG. 4). The toner discharge port 377 is disposed at a bottom of the toner container 30 corresponding to the toner supply port 25 of the developing device 20. The toner falling from the toner discharge port 377 is replenished from the toner supply port 25 to the developing device 20. Details of the toner supply device 3 will be described later.

Figure 5:
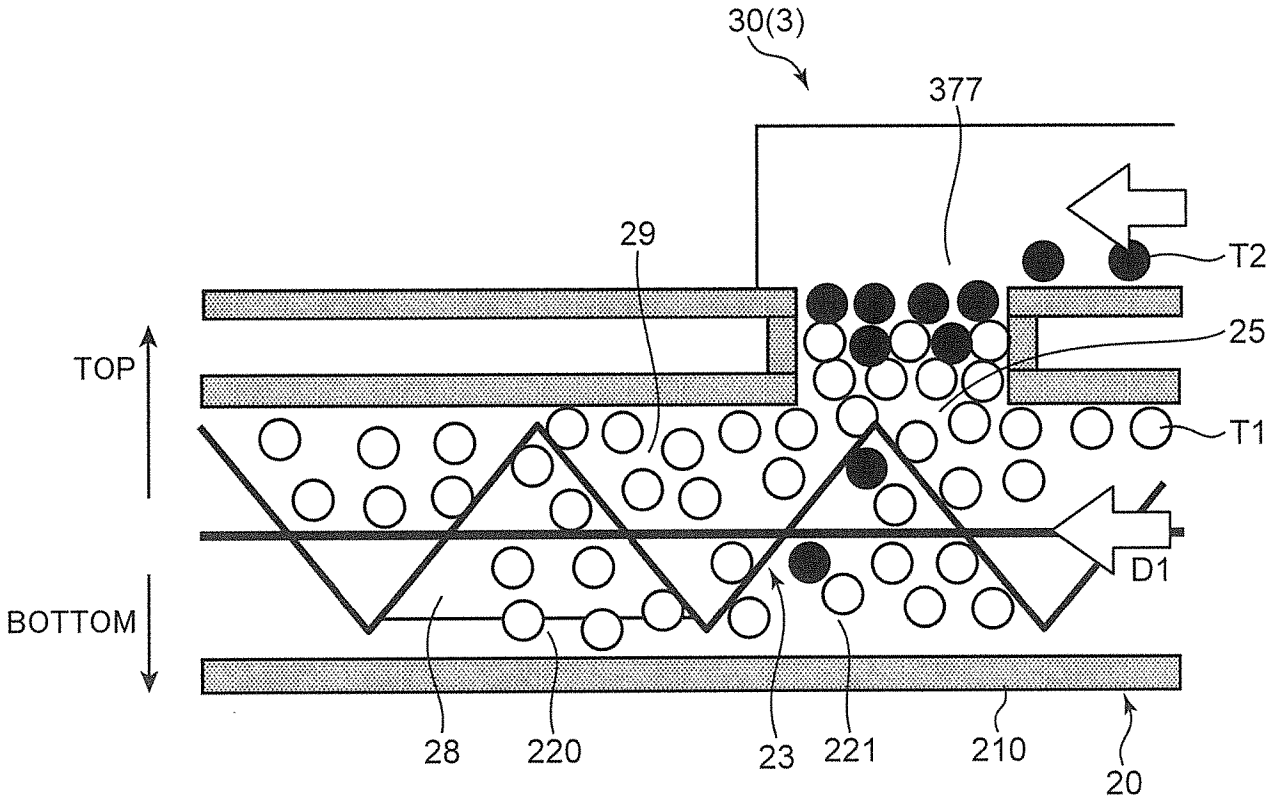
FIG. 5 is a diagram for describing how a developer is replenished to the developing device.

Next, a flow of the toner newly replenished from the toner supply port 25 will be described with reference to FIG. 5. FIG. 5 is a cross-sectional view of a vicinity of the toner supply port 25 disposed in the developing device 20 and the toner discharge port 377 disposed in the toner container 30.

A replenishment toner T2 supplied from the toner discharge port 377 of the toner container 30 falls into the first conveyance passage 221 and mixes with an existing toner T1 and is conveyed in the arrow D1 direction by the first stirring screw 23. At this time, the toners T1 and T2 are stirred and charged.

The first stirring screw 23 is provided with a reducing paddle 28 (a conveying ability reducing portion) which partially reduces toner conveying performance on a downstream side in the toner conveying direction of the toner supply port 25. In the present embodiment, the reducing paddle 28 is a plate member disposed between the adjacent first spiral blades 23*b* of the first stirring screw 23. As the reducing paddle 28 rotates about the first rotary shaft 23*a*, the toner conveyed from an upstream side of the reducing paddle 28 starts to stay. Then, the stagnation of these toners accumulates to a position immediately upstream of the reducing paddle 28 and where the toner supply port 25 faces the first conveyance passage 221. As a result, near an entrance of the toner supply port 25, a toner accumulation portion 29 is formed. Note that in a region where the toner supply port 25 faces, the first spiral blade 23*b* is disposed (FIG. 4). Further, in another embodiment, the conveying ability reducing portion may be formed such that the first spiral blade 23*b* of the first stirring screw 23 is partially missing and the first rotary shaft 23*a* is partially exposed along an axial direction. Also in such a configuration, since the conveying ability of the first stirring screw 23 is partially suppressed, a toner accumulation portion is formed.

When the replenishment toner T2 is replenished from the toner supply port 25 and a toner amount in the storage space 220 increases, the toner staying in this accumulation portion 29 closes (seals) the toner supply port 25, thereby suppressing further toner replenishment. In addition, the first spiral blade 23*b* pushes the toner in the storage space 220 around the toner supply port 25 upward by being rotated. As a result, sealing action of the toner supply port 25 by the accumulation portion 29 is increased. Thereafter, when the toner in the storage space 220 is consumed by the developing roller 21 and the toner staying in the accumulation portion 29 decreases, the toner closing the toner supply port 25 decreases, and a gap is generated between the accumulation portion 29 and the toner supply port 25. As a result, the replenishment toner T2 again flows into the storage space 220 from the toner supply port 25. As described above, the present embodiment employs a volume replenishment type toner supply method in which an amount of the replenishment toner to be received is adjusted as the amount of toner staying in the accumulation portion 29 decreases. Therefore, it is possible to replenish the toner to the developing device 20 without necessarily including a sensor for detecting a toner amount in the development housing 210 of the developing device 20.

<About Mounting of Toner Container to Developing Device>

Figure 6:
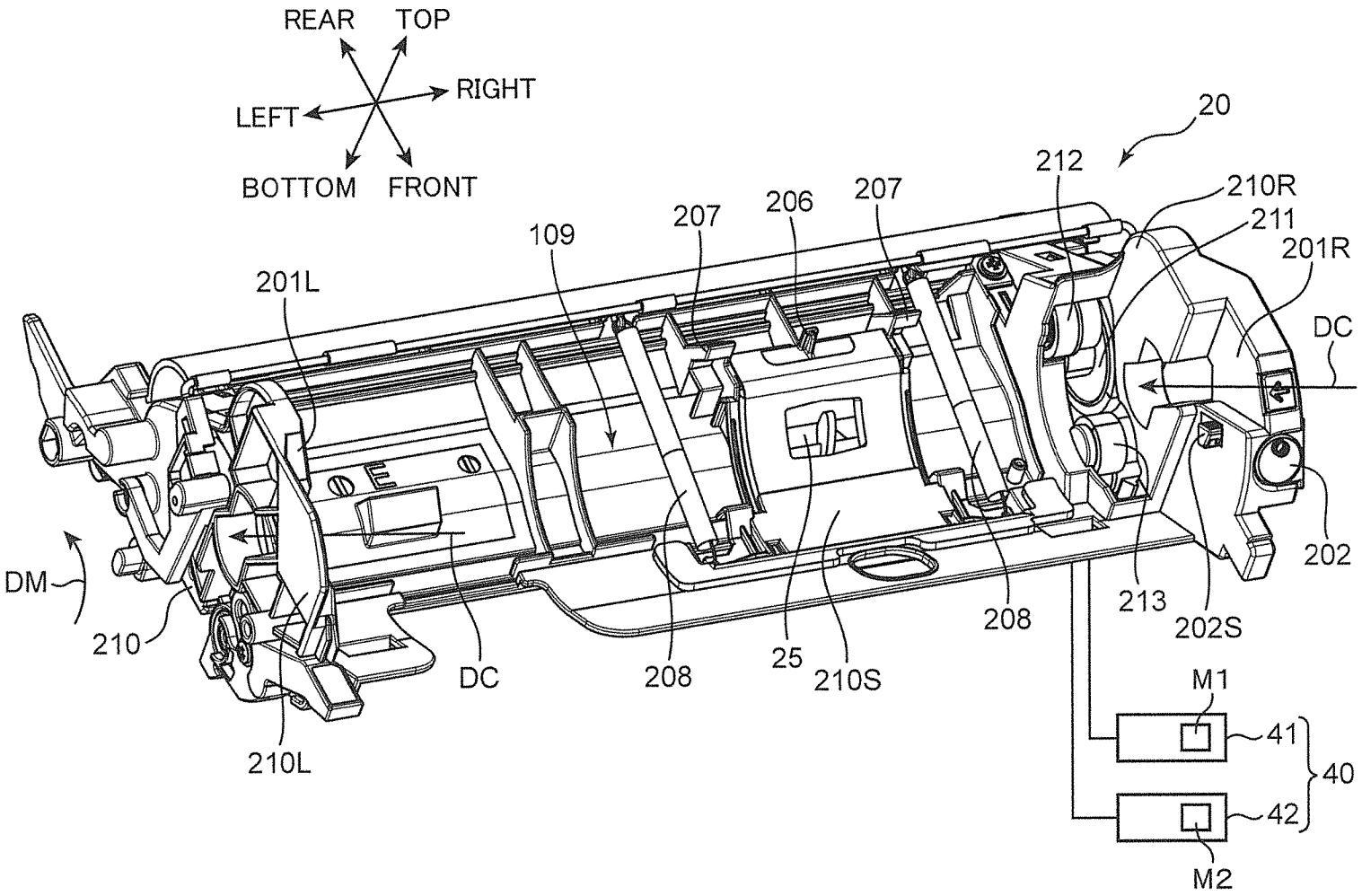
FIG. 6 is a perspective view of the developing device.
Figure 7:
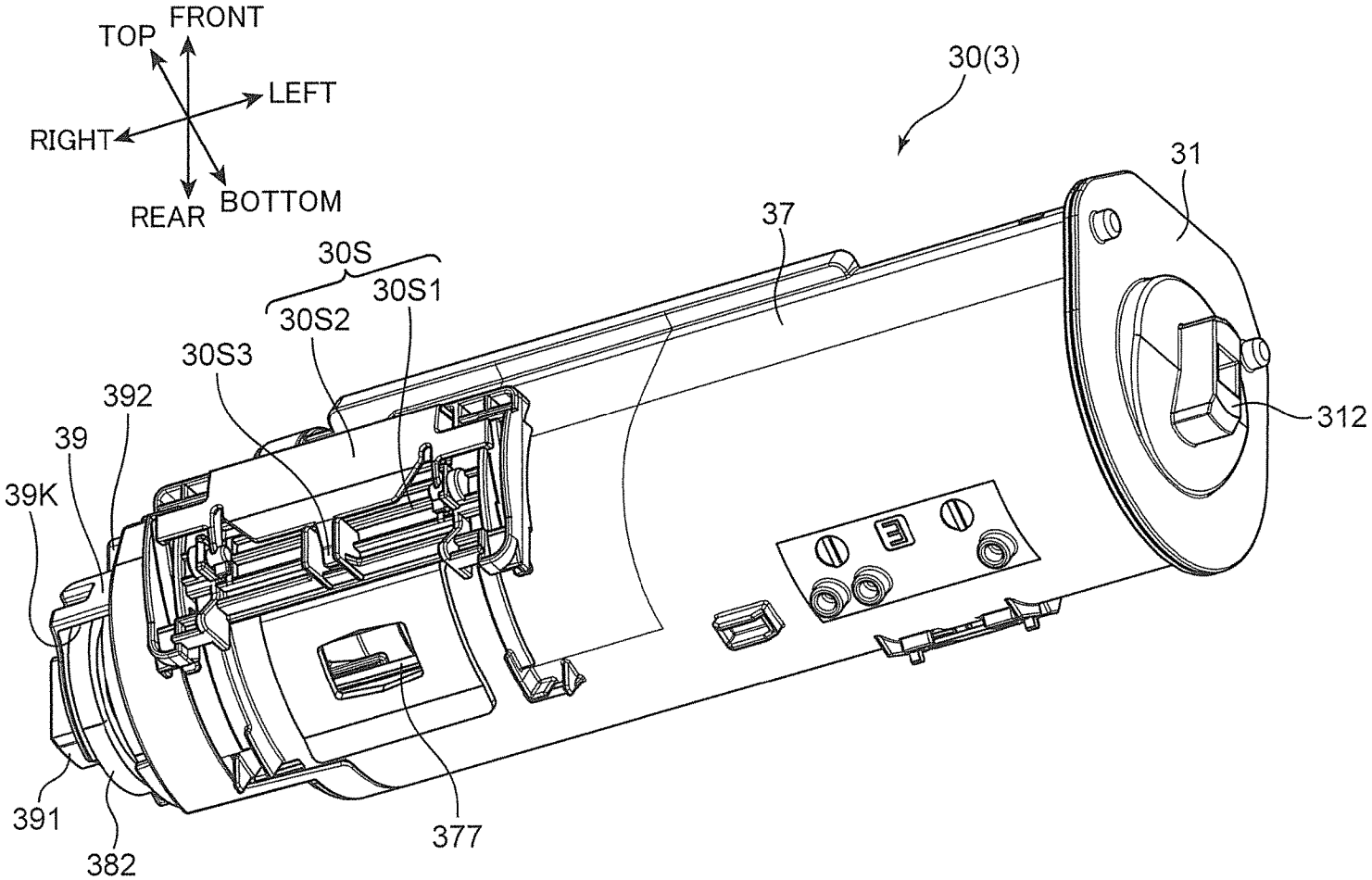
FIG. 7 is a perspective view of a developer container provided in a developer supply device of the image forming apparatus.

The toner container 30 of the toner supply device 3 is detachably mounted to the developing device 20 in the housing 101. FIGS. 6 and 7 are perspective views of the developing device 20 and the toner container 30 according to the present embodiment, respectively.

The toner container 30 includes a lid 31, a container main body 37 (a container main body), a cover 39, and a container shutter 30S (FIG. 7).

The container main body 37 is a main body of the toner container 30, and contains a toner therein. The lid 31 closes a left end of the container main body 37. The cover 39 is attached to a right end of the container main body 37.

The container shutter 30S is slidably supported with respect to the container main body 37. The container shutter 30S has a function of sealing and opening the toner discharge port 377 of the container main body 37. The container shutter 30S has a shutter main body 30S1, a shutter lock portion 30S2, and a lock release portion 30S3. The shutter main body 30S1 is a main body of the container shutter 30S and has a function of sealing and opening the toner discharge port 377. The shutter main body 30S1 is slidably supported with respect to the container main body 37. The shutter lock portion 30S2 is swingably supported with respect to the shutter main body 30S1. The shutter lock portion 30S2 has a function of allowing and restricting slide movement of the shutter main body 30S1 relative to the container main body 37. The lock release portion 30S3 is a projecting piece provided in the shutter lock portion 30S2. When the lock release portion 30S3 is pressed, a lock piece (not shown) provided in the shutter lock portion 30S2 is detached from an engagement part formed in the container main body 37, and the shutter main body 30S1 can slide.

With reference to FIG. 2, when the opening/closing cover 100C of the housing 101 is opened upward, a container attachment portion 109 provided in the development housing 210 of the developing device 20 is exposed to the outside of the housing 101. Referring to FIG. 6, the development housing 210 includes a pair of a housing left wall 210L and a housing right wall 210R. The container attachment portion 109 is formed between the housing left wall 210L and the housing right wall 210R. In the present embodiment, the toner container 30 is mounted obliquely above the container attachment portion 109 (see arrow DC in FIG. 6). At this time, the cover 39 of the toner container 30 is disposed on the housing right wall 210R, and the lid 31 of the toner container 30 is disposed on the housing left wall 210L. The development housing 210 has a left guide groove 201L and a right guide groove 201R (FIG. 6).

The left guide groove 201L and the right guide groove 201R are groove portions formed in the housing left wall 210L and the housing right wall 210R, respectively. The left guide groove 201L and the right guide groove 201R guide mounting of the toner container 30 on the container attachment portion 109. Therefore, entrance sides of the left guide groove 201L and the right guide groove 201R are formed so as to extend along a mounting direction of the toner container 30 (an arrow DC direction in FIG. 6). On the other hand, depth sides of the left guide groove 201L and the right guide groove 201R are formed in sector shapes so as to allow rotation of a first guide portion 312 (FIG. 7) and a second guide portion 391 (FIG. 7).

Further, referring to FIG. 6, the developing device 20 includes a first transmission gear 211, a second transmission gear 212, and a third transmission gear 213. In addition, as will be described in detail later, the toner supply device 3 includes a container driving unit 40 including a movable wall driving unit 41 and a rotating body driving unit 42. The first transmission gear 211, the second transmission gear 212, and the third transmission gear 213 are gears rotatably supported by the housing right wall 210R. The first transmission gear 211 is connected to the second transmission gear 212. Further, the first transmission gear 211 is connected to the developing roller 21, the first stirring screw 23, and the second stirring screw 24 via a gear group (not shown). When the developing device 20 is mounted on the housing 101, a movable wall driving motor M1 (a first driving motor) of the movable wall driving unit 41 is connected to the third transmission gear 213, and a rotating body driving motor M2 of the rotating body driving unit 42 is connected to the first transmission gear 211.

The movable wall driving motor M1 moves a later-described movable wall 32 of the toner container 30 by rotating a later-described shaft 33 of the toner container 30 via the third transmission gear 213. In other words, the third transmission gear 213 engages with a later-described shaft driving gear 382 of the movable wall driving unit 41 and transmits a driving force of the movable wall driving motor M1 to the shaft driving gear 382. The rotating body driving motor M2 rotates a later-described rotating body 35 of the toner container 30 via the first transmission gear 211 and the second transmission gear 212. Further, the rotating body driving motor M2 rotates the developing roller 21, the first stirring screw 23, and the second stirring screw 24 of the developing device 20 via the first transmission gear 211.

Further, the development housing 200 includes a lock release button 202, the above-described toner supply port 25, a releasing projection 206, a pair of container shutter fixing portions 207, a pair of shutter springs 208, and a housing shutter 210S.

The lock release button 202 is a pressing button slidably supported by the housing right wall 210R. The lock release button 202 has a function of locking a position of the toner container 30 mounted to the container attachment portion 109 or a function of releasing the lock. The lock release button 202 includes a lock engagement piece 202S. The lock engagement piece 202S is a claw formed so as to protrude toward the container attachment portion 109 on a front side of the housing right wall 210R. Further, the developing device 20 is provided with a lock biasing spring (not shown). The lock biasing spring is a coil spring that is disposed inside the housing right wall 210R and urges the lock release button 202 toward the front. The lock engagement piece 202S has a function of locking the position of the toner container 30 mounted to the container attachment portion 109. On the other hand, when the lock release button 202 is pressed against an urging force of the lock biasing spring, the lock engagement piece 202S separates from the toner container 30, and the lock function on the toner container 30 is released.

The above-described toner supply port 25 is an opening which is opened to the top plate of the development housing 200 in a substantially rectangular shape (FIG. 6). The toner supply port 25 communicates with an inside of the development housing 200. Further, the toner supply port 25 is disposed so as to face the toner container 30 mounted on the container attachment portion 109. The toner discharged from the toner discharge port 377 of the toner container 30 flows into the development housing 200 from the toner supply port 25.

The releasing projection 206 is a projection adjacent to the rear of the toner supply port 25 and protruding from the top plate of the development housing 200. The releasing projection 206 has a function of pressing the lock release portion 30S3 (FIG. 7) of the container shutter 30S of the toner container 30 when the toner container 30 is mounted to the container attachment portion 109. In other words, the releasing projection 206 allows the container shutter 30S to slide.

The pair of container shutter fixing portions 207 is a projection protruding from the top plate of the development housing 200 so as to sandwich the releasing projection 206 in the left and right direction. In a sectional view intersecting the left and right direction, the container shutter fixing portion 207 is formed in a substantially trapezoidal shape. Further, a wedge-shaped cutout portion is formed on a front side surface of the container shutter fixing portion 207. When the toner container 30 is mounted to the container attachment portion 109, a part of the container shutter 30S of the toner container 30 is engaged with the cutout portion. As a result, the container shutter fixing portions 207 fix the container shutter 30S and regulate movement (rotation) of the container shutter 30S.

The pair of shutter springs 208 is a pair of spring members disposed on an outer side in the left and right direction of the pair of container shutter fixing portions 207. The shutter springs 208 are disposed so as to extend in a front and rear direction. Rear ends of the pair of shutter springs 208 are engaged with the top plate of the development housing 200. Further, front ends of the pair of shutter springs 208 are respectively engaged with left and right ends of the housing shutter 210S.

The housing shutter 210S is supported by the development housing 200 so as to be slidable with respect to the toner supply port 25. The housing shutter 210S seals or opens the toner supply port 25.

The pair of shutter springs 208 described above urges the housing shutter 210S in a direction in which the housing shutter 210S seals the toner supply port 25. When the toner container 30 is detached from the developing device 20, the housing shutter 210S receives an urging force of the pair of shutter springs 208 and seals the toner supply port 25.

When the toner container 30 is mounted to the container attachment portion 109, the housing shutter 210S can press the container main body 37 of the toner container 30. Therefore, the shutter springs 208 urge, via the housing shutter 210S, the toner container 30 mounted to the container attachment portion 109 toward the direction in which the housing shutter 210S closes the toner supply port 25.

<About Toner Supply Device>

Figure 8:
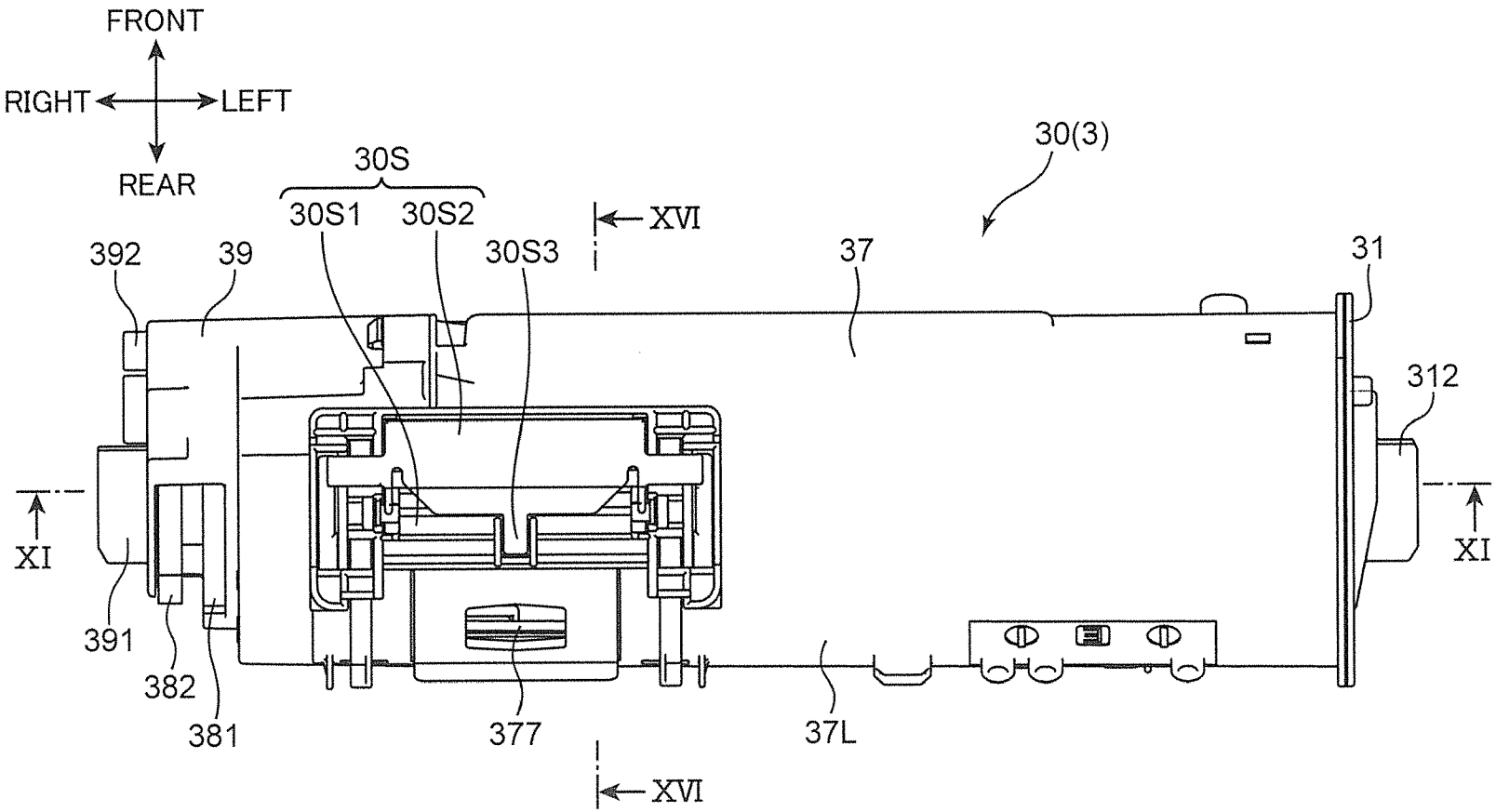
FIG. 8 is a plan view of the developer container.
Figure 9:
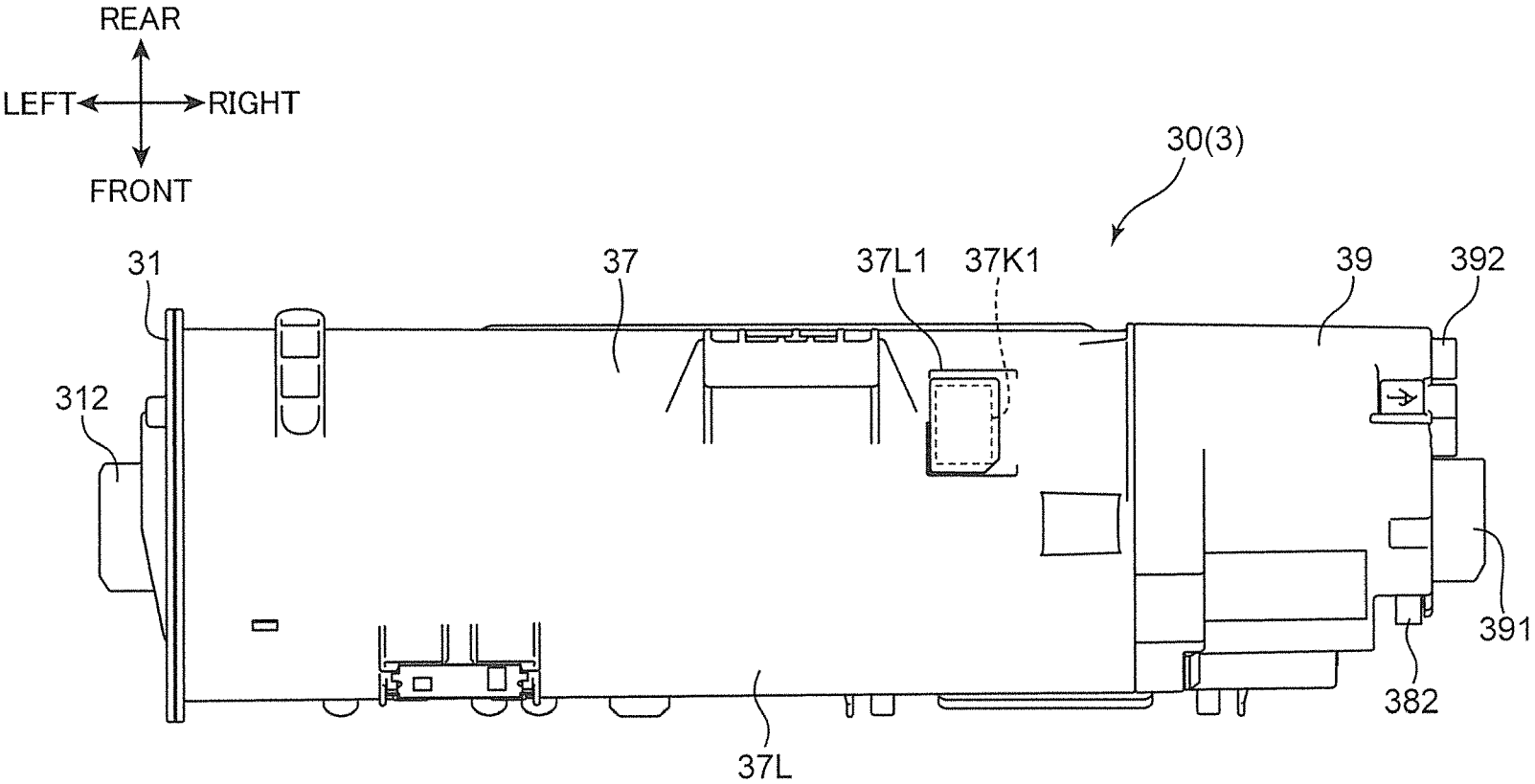
FIG. 9 is a plan view of the developer container.
Figure 10:
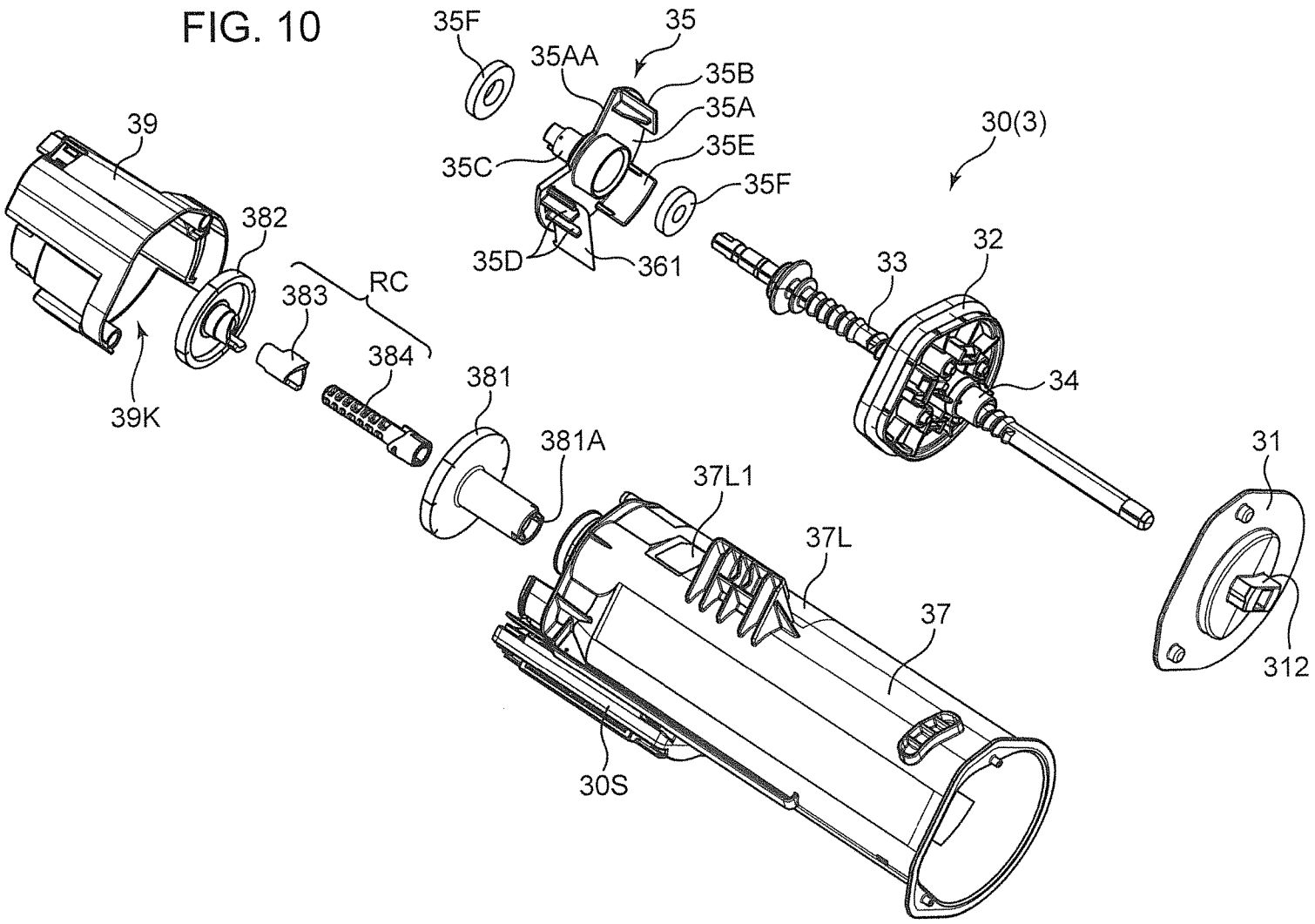
FIG. 10 is an exploded perspective view of the developer container.
Figure 11:
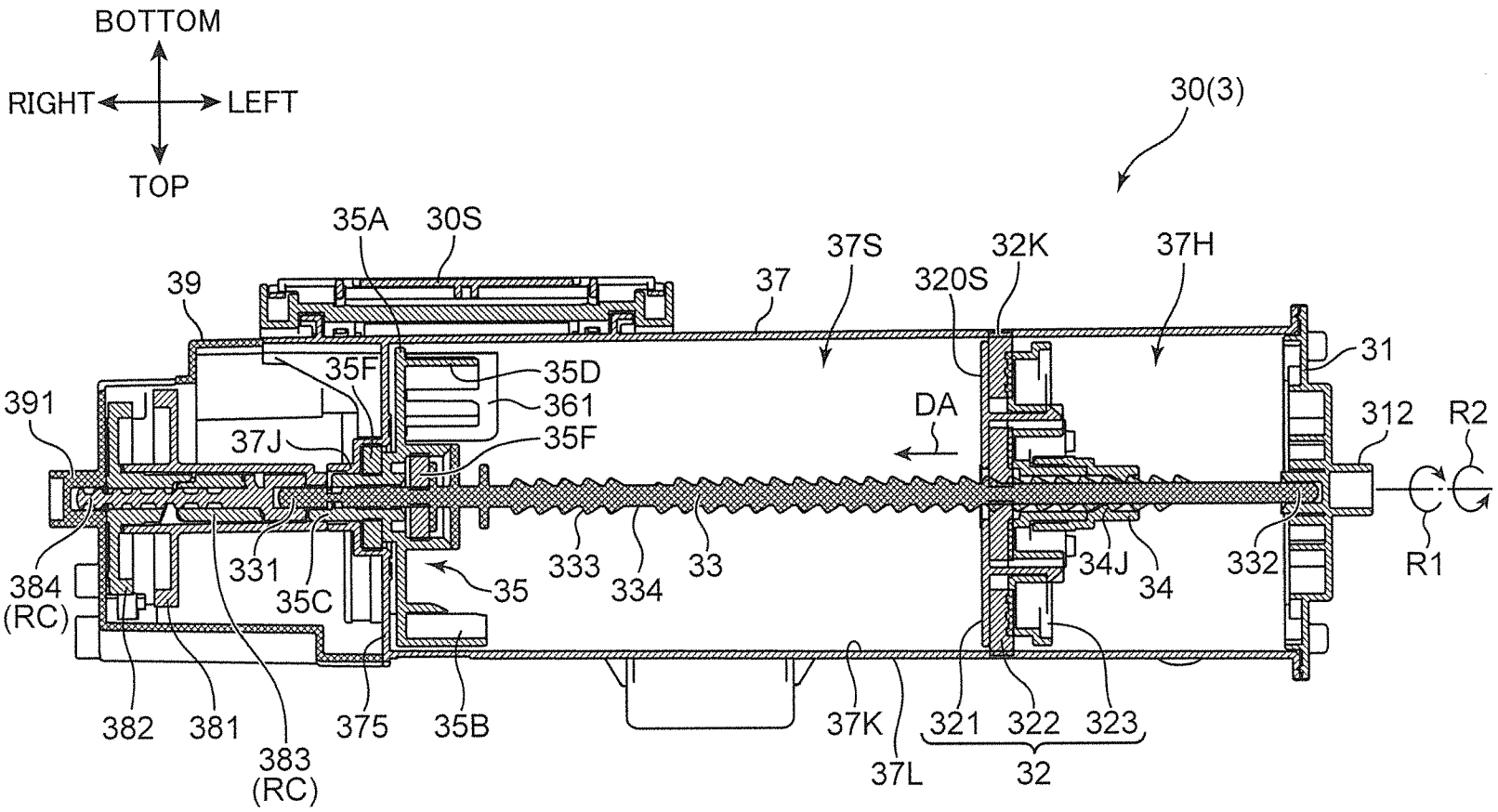
FIG. 11 is a cross-sectional view of the developer container in FIG. 8 as viewed from cutting plane line XI-XI.

Next, the toner supply device 3 will be described. As described above, the toner supply device 3 is a device that supplies a toner to the developing device 20, and includes the toner container 30 (the developer container) disposed above the toner supply port 25 of the development housing 210. The toner container 30 will be described with reference to FIGS. 8 to 11 in addition to FIG. 7. FIGS. 8 and 9 are plan views of the toner container 30. FIG. 10 is an exploded perspective view of the toner container 30. FIG. 11 is a cross-sectional view of the toner container 30 in FIG. 8, as viewed from cutting plane line XI-XI.

The toner container 30 has a cylindrical shape extending in the left and right direction (a first direction, an arrow DA direction in FIG. 11). The toner container 30 contains a replenishment toner (a developer) inside. The toner container 30 includes the movable wall 32, the shaft 33, a pressing member 34, the rotating body 35, a rotating body driving gear 381, the shaft driving gear 382, a ratchet gear 383, and a ratchet shaft 384 in addition to the lid 31, the container main body 37 (the container main body), and the cover 39 described above.

The lid 31 is fixed to the container main body 37 and seals an opening of the container main body 37. The lid 31 rotatably supports a second shaft end 332 (FIG. 11) of the shaft 33. The lid 31 includes the first guide portion 312. The first guide portion 312 is a projection formed to extend in the vertical direction on a left side surface (an outer surface) of the lid 31. The first guide portion 312 has a function of guiding the toner container 30 to be mounted to the developing device 20.

The container main body 37 is a main body of the toner container 30 having a cylindrical shape. The container main body 37 includes a right wall 375 (FIG. 11) and a protruding wall 376 (see FIG. 18 described later), and extends in the first direction DA (the left and right direction) to define an internal space 37H in which the toner is contained. The right wall 375 is disposed on one end side (a right end side) of the container main body 37 in the first direction DA, and is a wall that closes an inside of the container main body 37. Note that the internal space 37H is a space defined by an inner peripheral surface 37K formed by the container main body 37 and the right wall 375 and the lid 31. In addition, an area between the right wall 375 and the movable wall 32 in the internal space 37H is defined as a storage space 37S. The storage space 37S is a space in which a toner is contained in an interior (the internal space 37H) of the toner container 30.

As shown in FIG. 11, an opposite side of the right wall 375 of the container main body 37 in the first direction DA is opened. When the lid 31 is fixed to the opening, the lid 31 closes the internal space 37H of the container main body 37. Note that an outer peripheral edge of the lid 31 is ultrasonically welded to the container main body 37.

Figure 18:
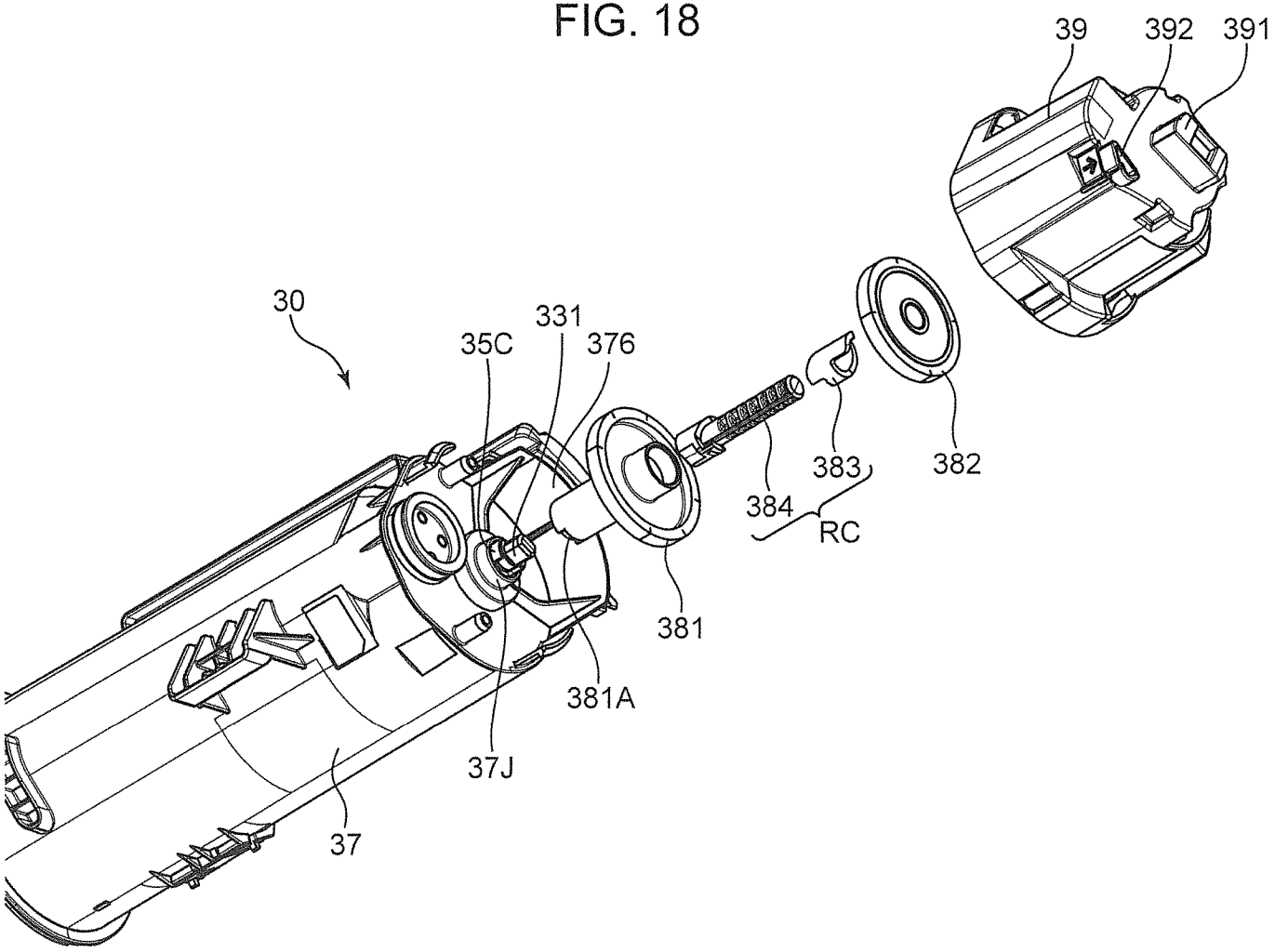
FIG. 18 is an exploded perspective view of the developer container, showing a ratchet mechanism.

With reference to FIG. 18, the protruding wall 376 is a portion where an outer peripheral surface 37L of the container main body 37 protrudes to a right side of the right wall 375. The cover 39 is attached to the protruding wall 376. The cover 39 has a function of exposing parts in a circumferential direction of the rotating body driving gear 381 and the shaft driving gear 382 to the outside and covering other parts in the circumferential direction of the rotating body driving gear 381 and the shaft driving gear 382. The cover 39 includes the above-described second guide portion 391 (see FIG. 11), a container engagement portion 392, and a gear opening 39K (see FIG. 7).

The second guide portion 391 is a projection protruding rightward along the vertical direction on a right side surface of the cover 39. The second guide portion 391 has a function of guiding the toner container 30 to be mounted to the developing device 20 together with the first guide portion 312 of the lid 31. The container engagement portion 392 is a projection protruding from the right side surface of the cover 39 with a space from the second guide portion 391. The lock engagement piece 202S of the lock release button 202 can be engaged with the container engagement portion 392.

The gear opening 39K is an opening in which a lower surface of the cover 39 is opened with a semicircular arc shape. When the cover 39 is attached to the container main body 37, parts of gear teeth of the rotating body driving gear 381 and the shaft driving gear 382 are exposed to the outside of the toner container 30 via the gear opening 39K. As a result, when the toner container 30 is mounted to the development housing 210 of the developing device 20, the rotating body driving gear 381 and the shaft driving gear 382 are respectively engaged with the second transmission gear 212 and the third transmission gear 213 (FIG. 6).

The container main body 37 includes the above-described toner discharge port 377 (the developer discharge port) and a main body bearing 37J (FIG. 11). The toner discharge port 377 is opened on a lower surface of the right end of the container main body 37 so as to communicate with the internal space 37H. In other words, the toner discharge port 377 is disposed adjacent to the right wall 375 in the first direction DA. Further, the toner discharge port 377 is opened to have a rectangular shape with a predetermined length along the first direction DA and a predetermined width along an arc shape of the lower surface of the container main body 37. In the present embodiment, the toner discharge port 377 is opened rearward and upward along the circumferential direction with respect to a lower end of the lower surface of the container main body 37. The toner discharge port 377 allows a toner to be discharged from the storage space 37S toward the developing device 20.

The main body bearing 37J (FIG. 11) is a bearing formed on the right wall 375. The shaft 33 is inserted through the main body bearing 37J. At this time, a right end side (a first shaft end 331) of the shaft 33 protrudes to the outside of the container main body 37.

The shaft 33 is disposed so as to extend in the first direction DA in the internal space 37H. The shaft 33 is rotatably supported by the right wall 375 of the container main body 37 and the lid 31. The shaft 33 includes the first shaft end 331, the second shaft end 332, a male spiral portion 333, and a movable wall stop portion 334.

Referring to FIG. 11, the first shaft end 331 is a distal end of the shaft 33 that protrudes rightward through the main body bearing 37J. On a peripheral surface of the first shaft end 331, a pair of D planes is formed (see FIG. 18). The ratchet shaft 384 constituting a later-described ratchet mechanism RC is engaged with the first shaft end 331. As a result, the shaft 33 and the ratchet shaft 384 are integrally rotatable. The second shaft end 332 is a left end of the shaft 33. The second shaft end 332 is pivotally supported by a shaft hole formed in the lid 31 as described above.

The male spiral portion 333 is a thread helically formed on an outer peripheral surface of the shaft 33 along the first direction DA in the internal space 37H. In the present embodiment, as shown in FIG. 11, the male spiral portion 333 is disposed from a region adjacent to the lid 31 of the shaft 33 to a region upstream in the first direction DA of the toner discharge port 377.

The movable wall stop portion 334 is disposed continuously on a downstream side in the first direction DA of the male spiral portion 333. The movable wall stop portion 334 is a region of only a shaft in which the male spiral portion 333 is partially missing in the shaft 33 in the internal space 37H. The movable wall stop portion 334 is located above the toner discharge port 377 and on an upstream side in the first direction DA of the toner discharge port 377.

The movable wall 32 is inserted through the shaft 33. When the shaft 33 rotates in a first rotating direction R1 (see FIG. 11) around an axis in which the shaft 33 extends in the first direction DA, the movable wall 32 is moved in the first direction DA along the shaft 33. As a result, the movable wall 32 conveys the toner in the internal space 37H toward the toner discharge port 377. In the present embodiment, the movable wall 32 receives a driving force from the pressing member 34 as the shaft 33 rotates. The pressing member 34 is disposed on the upstream side in the first direction DA of the movable wall 32. The pressing member 34 is a cylindrical member that allows the shaft 33 to be inserted therethrough, and has a function of pressing the movable wall 32 in the first direction DA. On an inner peripheral surface of the pressing member 34, a female spiral portion 34J is formed. The pressing member 34 moves the movable wall 32 toward the toner discharge port 377 in the first direction DA by engagement between the male spiral portion 333 of the shaft 33 and the female spiral portion 34J of the pressing member 34.

The movable wall 32 defines one end surface (a left end surface) of the storage space 37S in the first direction DA in the internal space 37H. Note that another end surface (a right end surface) of the storage space 37S in the first direction DA is defined by the right wall 375. The movable wall 32 moves from an initial position on one end side to a final position on another end side in the first direction DA in the internal space 37H, while conveying the toner in the storage space 37S toward the toner discharge port 377 from a start of use to an end of use of the toner container 30. The initial position of the movable wall 32 is located on a right side (the downstream side in the first direction DA) of the lid 31, and the final position is located on an immediate left side (the upstream side in the first direction DA) of the toner discharge port 377.

Figure 12:
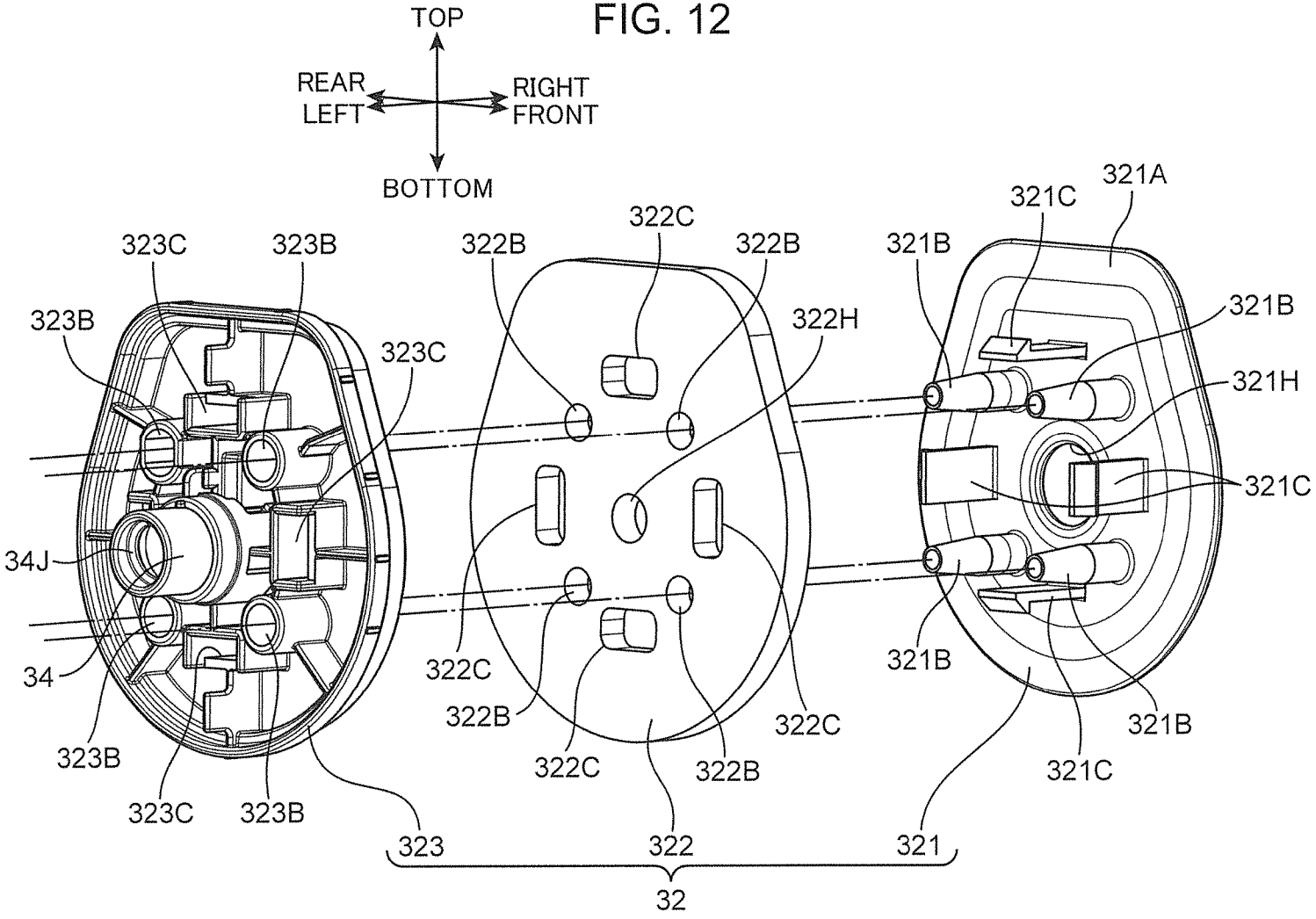
FIG. 12 is an exploded perspective view of a movable wall of the developer container.
Figure 13:
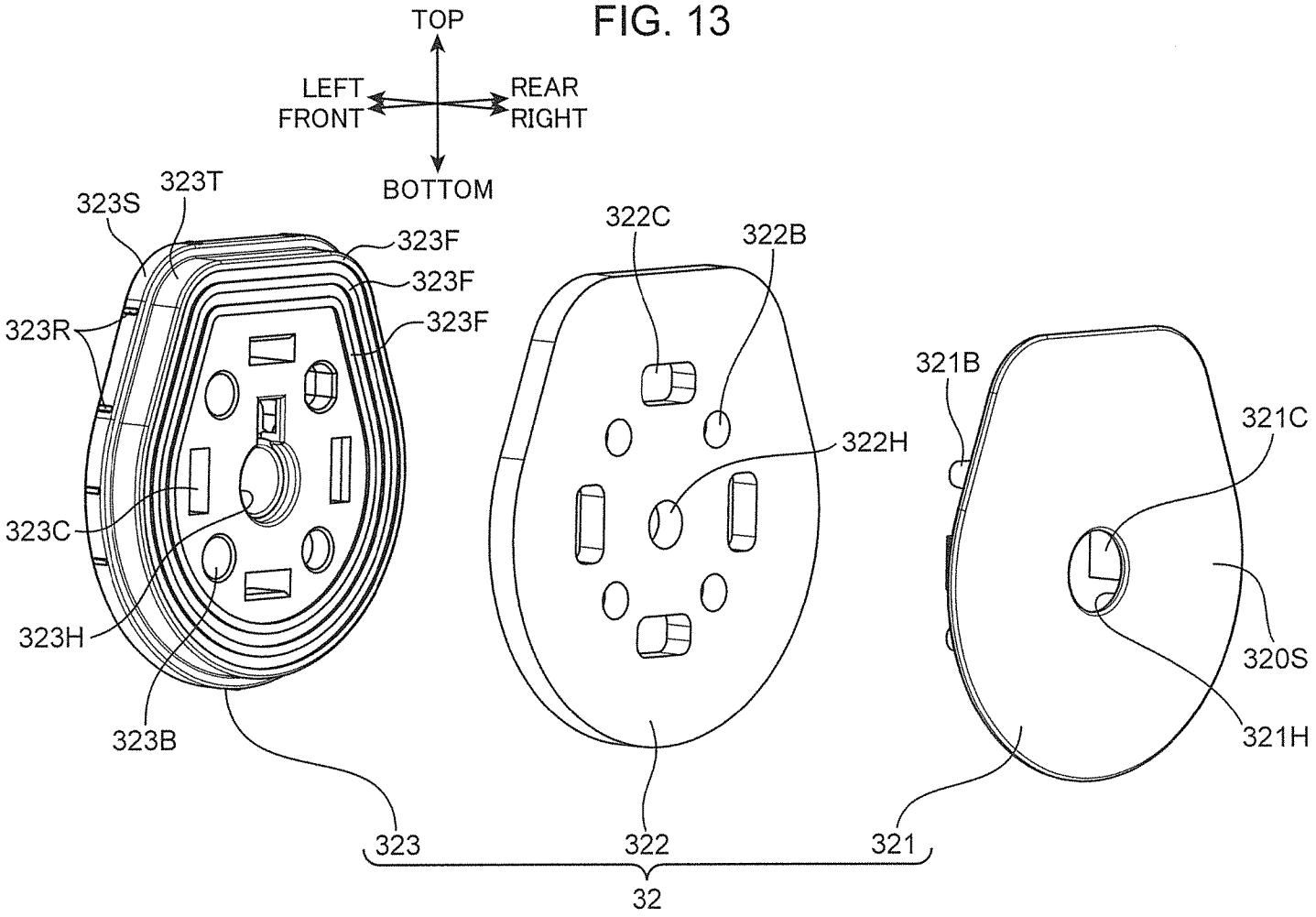
FIG. 13 is an exploded perspective view of the movable wall of the developer container.
Figure 14:
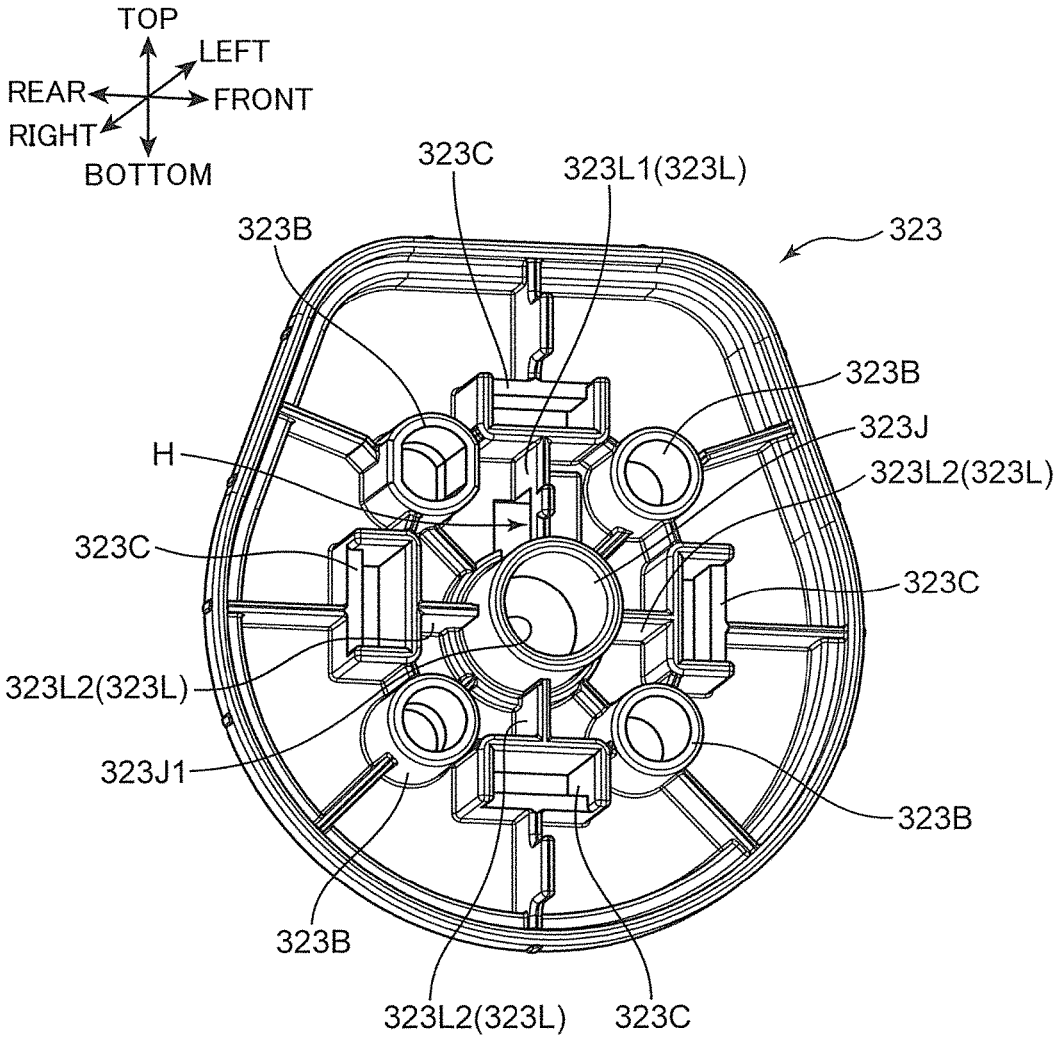
FIG. 14 is a perspective view of a wall main body of the movable wall.
Figure 15:
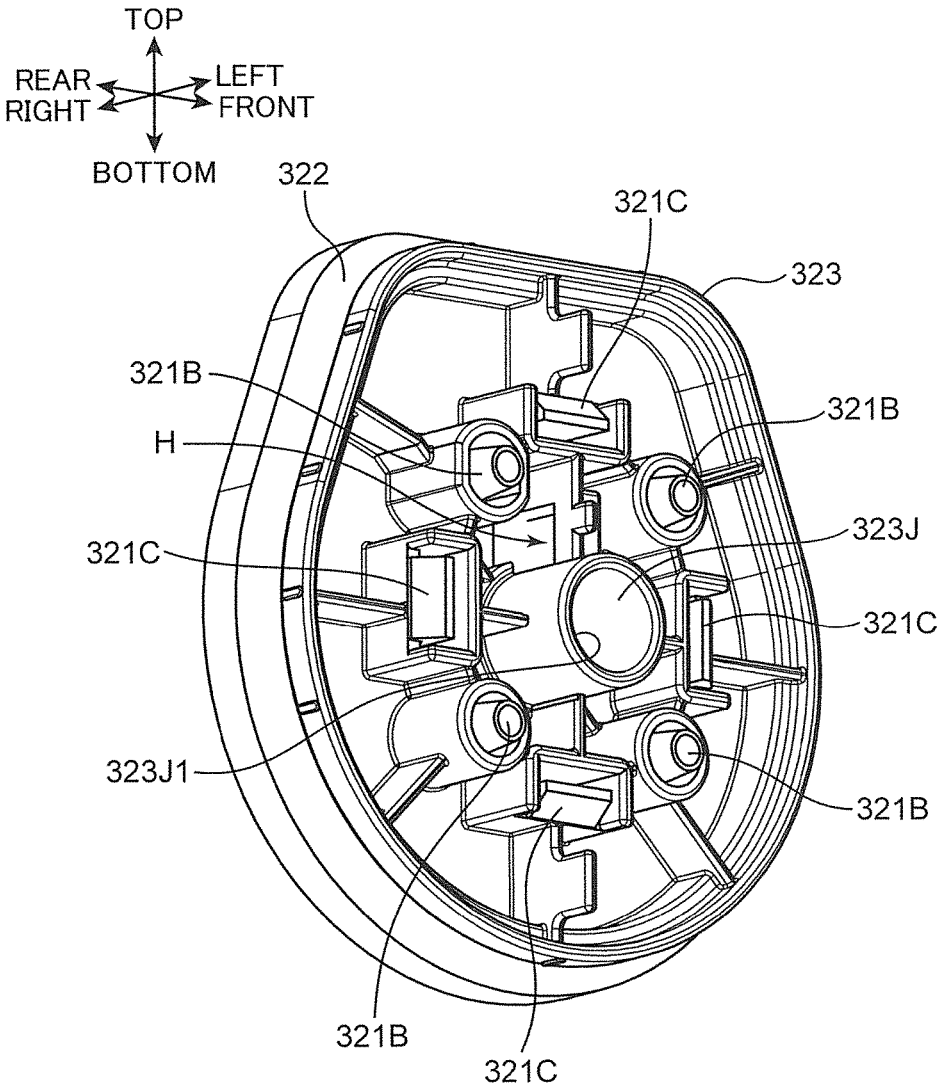
FIG. 15 is a perspective view of the movable wall.

With reference to FIGS. 12 to 15, a detailed structure of the movable wall 32 will be described as follows. FIGS. 12 and 13 are exploded perspective views of the movable wall 32, which are perspective views viewed from different viewpoints. Note that, in FIG. 12, the pressing member 34 also appears. FIG. 14 is a perspective view of a wall main body 323 of the movable wall 32. FIG. 15 is a perspective view of the movable wall 32.

The movable wall 32 includes a wall plate 321, a seal member 322, and the wall main body 323. In other words, the movable wall 32 is composed of three plate members. Note that outer peripheries of the wall plate 321, the seal member 322, and the wall main body 323 are formed in similar shapes. In other words, a lower end of the movable wall 32 has an arc shape protruding downward, an upper end of the movable wall 32 is formed by a horizontal flat portion, and both sides of the movable wall 32 are formed by inclined portions connecting the arc shape and the flat portion described above.

The wall plate 321 is disposed on the most downstream side in the first direction DA of the movable wall 32. The wall plate 321 is molded by resin molding. The wall plate 321 includes a plate main body 321A, four studs 321B, and four engagement pieces 321C. The plate main body 321A is a main body of the wall plate 321 and is a plate-shaped portion facing in the left and right direction. A plate shaft hole 321H is opened in a center of the plate main body 321A. The shaft 33 is inserted through the plate shaft hole 321H. A right side surface of the plate main body 321A constitutes a conveying surface 320S. The conveying surface 320S defines the storage space 37S in which the toner is contained together with the inner peripheral surface 37K of the container main body 37. As the movable wall 32 moves, the conveying surface 320S conveys the toner in the storage space 37S while pressing.

The four studs 321B are protruded leftward from a left side surface of the plate main body 321A (toward the wall main body 323). The stud 321B has a cylindrical shape, and its distal end is tapered. Two of the four studs 321B are disposed above the plate shaft hole 321H with a space therebetween in the front and rear direction, and the remaining two studs 321B are disposed below the plate shaft hole 321H with a space therebetween in the front and rear direction. The four studs 321B have a function of positioning the wall plate 321 with respect to the wall main body 323.

Similarly to the studs 321B, the four engagement pieces 321C are protruded leftward from the left side surface of the plate main body 321A (toward the wall main body 323). The engagement piece 321C is formed in a hook shape, and has a claw shape at a distal end thereof. The one engagement piece 321C is disposed right above the plate shaft hole 321H, the two engagement pieces 321C are disposed in front of and behind the plate shaft hole 321H, and the one engagement piece 321C is disposed below the plate shaft hole 321H. In other words, the four engagement pieces 321C are respectively disposed between the four studs 321B in a circumferential direction. The four engagement pieces 321C have a function of fixing the wall plate 321 to the wall main body 323.

The seal member 322 is disposed in a center in the first direction DA of the movable wall 32 and sandwiched between the wall plate 321 and the wall main body 323. The seal member 322 is made of a urethane material having a predetermined thickness in the first direction DA. A seal shaft hole 322H is opened in a center of the seal member 322. The shaft 33 is inserted through the seal shaft hole 322H. Further, four stud insertion holes 322B and four engagement piece insertion holes 322C are opened so as to surround the seal shaft hole 322H in the seal member 322. The four stud insertion holes 322B allow the above-described four studs 321B to be inserted therethrough. Similarly, the four engagement piece insertion holes 322C allow the above-described four engagement pieces 321C to be inserted therethrough. As a result, a position of the seal member 322 with respect to the wall plate 321 and the wall main body 323 of the movable wall 32 is restricted. In other words, the seal member 322 is constrained in the vertical direction and the left and right direction. Note that the outer periphery of the seal member 322 constitutes an outer peripheral surface 32K of the movable wall 32 (see FIG. 11). The outer peripheral surface 32K is disposed in contact with the inner peripheral surface 37K of the container main body 37 and compressively deformed.

The wall main body 323 is disposed on the upstream side in the first direction DA of the wall plate 321 and the seal member 322, that is, on the most upstream side in the first direction DA of the movable wall 32. The wall main body 323 is molded by resin molding. As shown in FIG. 13, the wall main body 323 includes a large diameter portion 323S and a small diameter portion 323T. In other words, the wall main body 323 has a stepped shape along the first direction DA, and the downstream side in the first direction DA (the small diameter portion 323T) is smaller than the upstream side in the first direction DA (the large diameter portion 323S). A cylinder 323J is disposed in a center of the wall main body 323 (see FIG. 14). The cylinder 323J has a cylindrical shape protruding from the wall main body 323 toward the upstream side in the first direction DA. A wall main body shaft hole 323H is formed inside a cylinder of the cylinder 323J (see FIG. 13). The shaft 33 is inserted through the wall main body shaft hole 323H. Further, the cylinder 323J is inserted into a cylinder of the pressing member 34. A distal end (a front end) on the upstream side in the first direction DA of the cylinder 323J is formed in a ring shape and functions as a pressed portion 323J1 (see FIG. 14) pressed by the pressing member 34.

As shown in FIG. 14, the wall main body 323 includes four stud receiving portions 323B, four wall engagement portions 323C, and four wall surface ribs 323L. The four stud receiving portions 323B allow the above-described four studs 321B to be inserted therethrough. Likewise, the four wall engagement portions 323C allow the above-described four engagement pieces 321C to be locked (see FIG. 15). The four wall surface ribs 323L are ribs protruding from a left side surface of the wall main body 323, and each of the wall surface ribs 323L extends so as to connect the stud receiving portion 323B and the wall engagement portion 323C. The four wall surface ribs 323L have one first wall surface rib 323L1 and three second wall surface ribs 323L2. The first wall surface rib 323L1 extends upward from an upper end of the cylinder 323J. The three second wall surface ribs 323L2 respectively extend radially outward from left and right ends and a lower end of the cylinder 323J. An insertion hole H is formed in the first wall surface rib 323L 1. The insertion hole H is an opening formed so as to penetrate the first wall surface rib 323L1 in the front and rear direction, and the pressing member 34 can be inserted.

With reference to FIG. 13, on a right side surface of the wall main body 323, three seal pressing ribs 323F are provided annularly in the circumferential direction of the shaft 33 so as to surround the four stud receiving portions 323B and the four wall engagement portions 323C, and protrude toward the seal member 322. Each of the three seal pressing ribs 323F is a rib having a shape similar to an outer peripheral shape of the wall main body 323, and the seal pressing ribs 323F are disposed with a predetermined space in a radial direction from each other. The outermost seal pressing rib 323F is disposed near an outer periphery of the small diameter portion 323T. The innermost seal pressing rib 323F is disposed close to the four stud receiving portions 323B and the four wall engagement portions 323C. These seal pressing ribs 323F have a function of abutting against a side surface of the seal member 322 to press the seal member 322 and regulating a radial base end position of a compressively deformed portion of the seal member 322.

Referring to FIG. 13, a plurality of outer peripheral ribs 323R are disposed on an outer periphery of the large diameter portion 323S with spaces in the circumferential direction. The plurality of outer peripheral ribs 323R slightly contact the inner peripheral surface 37K of the container main body 37, thereby maintaining a position of the movable wall 32.

Referring to FIGS. 11 and 13, when the wall plate 321, the seal member 322, and the wall main body 323 are integrated, the outer periphery of the seal member 322 is disposed on a radially outermost side. As a result, the outer periphery of the seal member 322 (the outer peripheral surface 32K of the movable wall 32) is compressively deformed by the inner peripheral surface 37K of the container main body 37. As a result, the toner in the storage space 37S is prevented from flowing out from between the inner peripheral surface 37K of the container main body 37 and the outer peripheral surface 32K of the movable wall 32 to the upstream side in a moving direction (the first direction DA) of the movable wall 32. At this time, the radial base end position of the compressively deformed portion is restricted by the plurality of seal pressing ribs 323F. Therefore, the compressed portion of the outer periphery of the seal member 322 is limited, and a strong pressing force can be maintained toward the inner peripheral surface 37K of the container main body 37. In addition, the outer periphery of the large diameter portion 323S of the wall main body 323 and the outer periphery of the wall plate 321 are disposed slightly radially inward of the outer periphery of the seal member 322.

Thus, the planar (plate-shaped) seal member 322 is sandwiched between the wall plate 321 and the wall main body 323, whereby detachment of the outer periphery of the seal member 322 is suppressed as the movable wall 32 moves. In other words, compared to a mode in which a tape-shaped seal member is wound around an outer periphery of the movable wall 32, occurrence of seal turning-up is prevented. Further, the small diameter portion 323T is disposed radially inward of the large diameter portion 323S. As a result, when the movable wall 32 moves in the first direction DA, the outer periphery of the seal member 322 is allowed to enter a step between the large diameter portion 323S and the small diameter portion 323T on the upstream side in the first direction DA. Therefore, damage of the outer periphery of the seal member 322 caused by application of an excessive load to the outer periphery is prevented.

Referring to FIGS. 12 and 13, when the seal member 322 is sandwiched between the wall plate 321 and the wall main body 323, a periphery of the seal shaft hole 322H in the seal member 322 is crushed. As a result, a shaft seal portion is formed so as to be in close contact with the outer peripheral surface of the shaft 33 over the entire circumferential direction. The shaft seal portion is disposed on the upstream side in the first direction DA of the female spiral portion 34J of the pressing member 34 (see FIG. 11). Therefore, the shaft seal portion comes into contact with the male spiral portion 333 of the shaft 33 before the female spiral portion 34J, and cleans the toner attached to the male spiral portion 333. Further, since the shaft seal portion has a ring shape so as to surround the shaft 33, the shaft seal portion is brought into close contact with the shaft 33 over the entire circumferential direction of the shaft 33. Therefore, the toner in the storage space 37S is prevented from flowing out to the upstream side in the moving direction (the first direction DA) of the movable wall 32 through a bearing of the movable wall 32.

Figure 16:
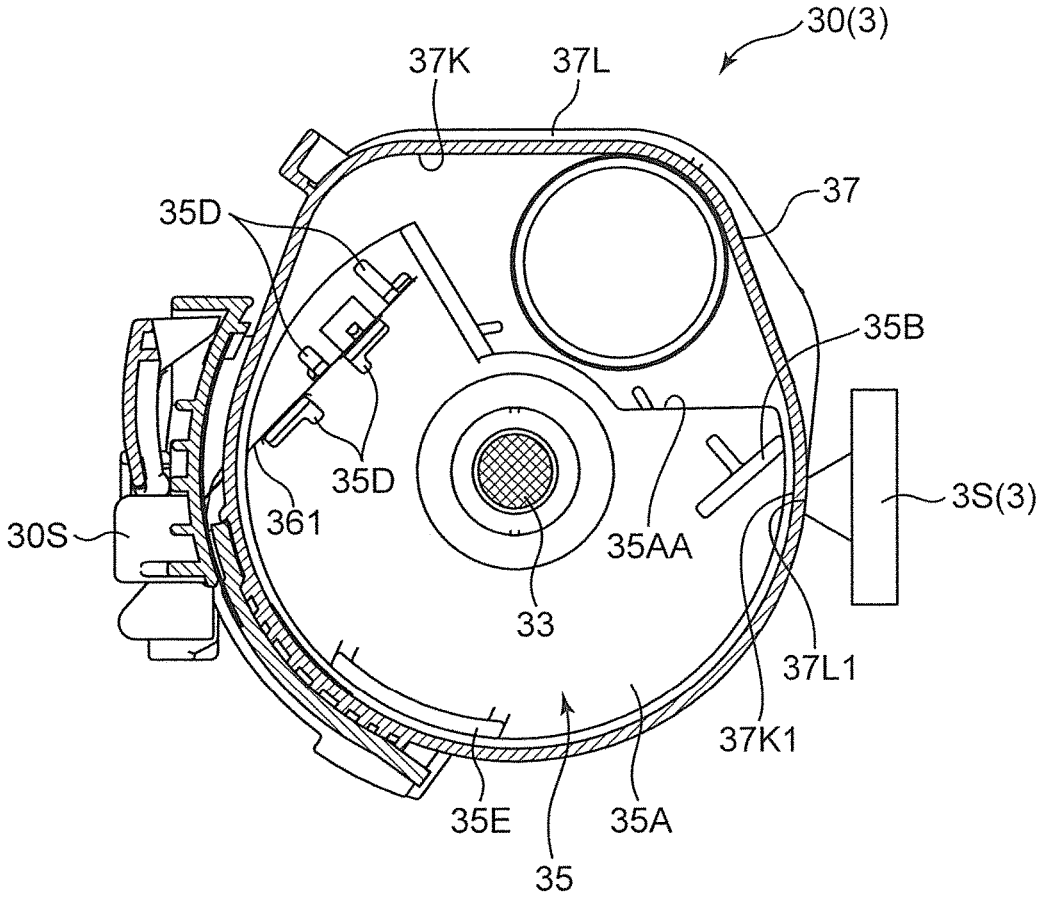
FIG. 16 is a cross-sectional view of the developer container of FIG. 8 as viewed from cutting plane line XVI-XVI.
Figure 17:
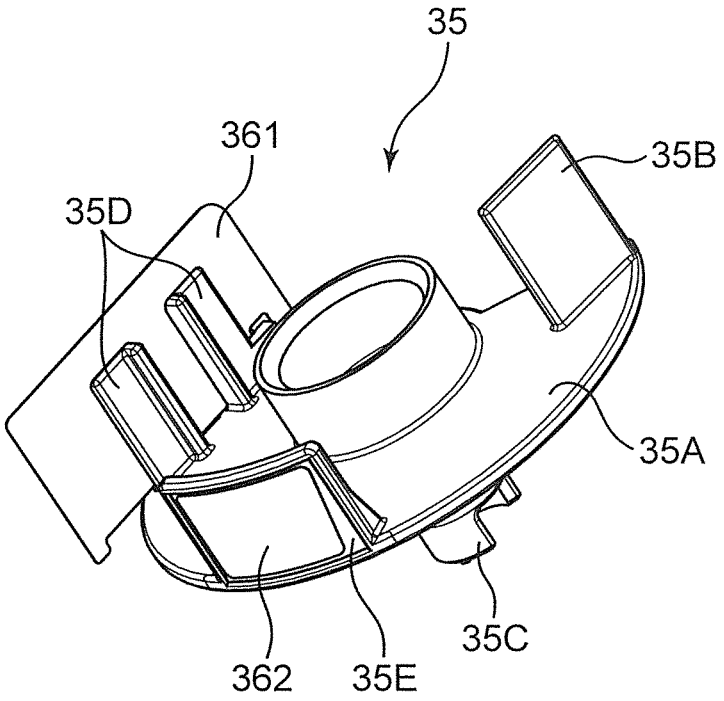
FIG. 17 is a perspective view of a rotating body of the developer container.

Next, in addition to FIGS. 10 and 11, the rotating body 35 provided in the toner container 30 will be described with reference to FIGS. 16 and 17. FIG. 16 is a cross-sectional view of the toner container 30 in FIG. 8 as viewed from cutting plane line XVI-XVI. FIG. 17 is a perspective view of the rotating body 35.

The rotating body 35 is disposed close to the toner discharge port 377 in the internal space 37H of the container main body 37 and rotates about the shaft 33 extending in the first direction DA. Specifically, the rotating body 35 is disposed along the right wall 375 above the toner discharge port 377. The rotating body 35 includes a plate 35A, a stirring blade 35B, a rotating body bearing 35C, a first support projecting piece 35D, and a second support projecting piece 35E.

The plate 35A is a plate-shaped member in which a cutout portion 35AA is formed by cutting a part of an outer peripheral end of a disk-shaped member into an arc shape, and is made rotatable around the shaft 33. The plate 35A is inserted through the first shaft end 331 of the shaft 33, and is prevented from slipping out of the shaft 33 by a pair of retaining members 35F.

The stirring blade 35B is a blade extending from the plate 35A toward the upstream side in the first direction DA, that is, toward the movable wall 32. The stirring blade 35B revolves around the shaft 33 above the toner discharge port 377 as the plate 35A rotates. As a result, the stirring blade 35B stirs the toner in the storage space 37S.

The stirring bearing 35C is a cylinder extending rightward from the plate 35A, and accommodates the shaft 33 therein. Further, a tip of the stirring bearing 35C is engageable with the rotating body driving gear 381.

The first support projecting piece 35D is a projecting piece extending from the plate 35A toward the upstream side in the first direction DA, that is, toward the movable wall 32. The first support projecting piece 35D is disposed in the plate 35A with a space from the stirring blade 35B in the circumferential direction. A cleaning member 361 is attached to this first support projecting piece 35D. The cleaning member 361 is made of a flexible film member extending along a rotating direction (the circumferential direction) of the rotating body 35. The cleaning member 361 is made of a material having electrical insulation properties (for example, polyethylene terephthalate, PET). The cleaning member 361 revolves around the shaft 33 above the toner discharge port 377 as the rotating body 35 (the plate 35A) rotates. When the rotating body 35 rotates, the cleaning member 361 scrapes off the toner adhered to a specific region 37K1 (see FIG. 9) of the inner peripheral surface 37K while slid-contacting against the inner peripheral surface 37K of the container main body 37. Note that, in the inner peripheral surface 37K of the container main body 37, the specific region 37K1, which is an object to be cleaned by the cleaning member 361, is a region where a container sensor 3S (a detection sensor) described later faces. Further, the cleaning member 361 also has a function of sending out the toner in the storage space 37S from the toner discharge port 377.

The second support projecting piece 35E is a projecting piece extending from the plate 35A toward the upstream side in the first direction DA, that is, toward the movable wall 32. The second support projecting piece 35E is disposed in the plate 35A with spaces in the circumferential direction with respect to the stirring blade 35B and the first support projecting piece 35D. The second support projecting piece 35E revolves around the shaft 33 above the toner discharge port 377 and the specific region 37K1 as the plate 35A rotates. An attachment detection member 362 is affixed on an outer surface of the second support projecting piece 35E. The attachment detection member 362 is made of, for example, a copper tape member. As will be described in detail later, the attachment detection member 362 is used when attachment of the toner container 30 to the developing device 20 is detected.

The rotating body driving gear 381 constitutes a part of the rotating body driving unit 42 (FIG. 6) of the container driving unit 40. The rotating body driving gear 381 transmits a driving force of the rotating body driving motor M2 (FIG. 6) to the rotating body 35. The rotating body driving gear 381 is connected to the rotating body driving motor M2 via the first transmission gear 211 and the second transmission gear 212 of the developing device 20. The rotating body driving gear 381 is rotated in synchronization with the developing roller 21, the first stirring screw 23, and the second stirring screw 24 of the developing device 20. The rotating body driving gear 381 is connected to the tip of the stirring bearing 35C of the rotating body 35 penetrating the main body bearing 37J. As a result, the rotating body driving gear 381 and the rotating body 35 rotate integrally.

As shown in FIG. 16, the container sensor 3S (the detection sensor) is disposed so as to face the specific region 37K1 on the inner peripheral surface 37K of the container main body 37 from the outside of the container main body 37. In other words, the container sensor 3S is disposed so as to face a sensor facing region 37L1 (see FIGS. 9, 10 and 16), on the outer peripheral surface 37L of the container main body 37, corresponding to the specific region 37K1. On the inner peripheral surface 37K of the container main body 37, the specific region 37K1 is set above the toner discharge port 377 in the circumferential direction and at a height position which is substantially the same as the axis of the shaft 33 in the vertical direction.

The container sensor 3S constitutes a part of the toner supply device 3 and is a sensor capable of detecting the toner contained in the storage space 37S of the container main body 37. In the present embodiment, the container sensor 3S is a permeability sensor (a magnetic sensor). The container sensor 3S constituted by the permeability sensor detects a magnetic field in the storage space 37S of the container main body 37, the magnetic field changing at the same cycle as a rotation period of the rotating body 35, and converts the magnetic field into an electric signal. When the container sensor 3S detects the toner (the magnetic toner) contained in the storage space 37S of the container main body 37, the container sensor 3S has such a characteristic that the detected magnetic field is increased. The container sensor 3S outputs a High signal (hereinafter referred to as "H signal"), which is a signal indicating that the toner has been detected, when detecting a magnetic field having a strength equal to or greater than a predetermined value. On the other hand, the container sensor 3S outputs a Low signal (hereinafter referred to as "L signal") when the container sensor 3S is not in operation or when the strength of the magnetic field in the storage space 37S is less than the predetermined value.

In the toner supply device 3 of the present embodiment, moving operation of the movable wall 32 of the toner container 30 is controlled based on the signal output from the container sensor 3S, and toner supply control to the developing device 20 is executed. Details of the toner supply control for the developing device 20 in the toner supply device 3 will be described later.

Figure 19:
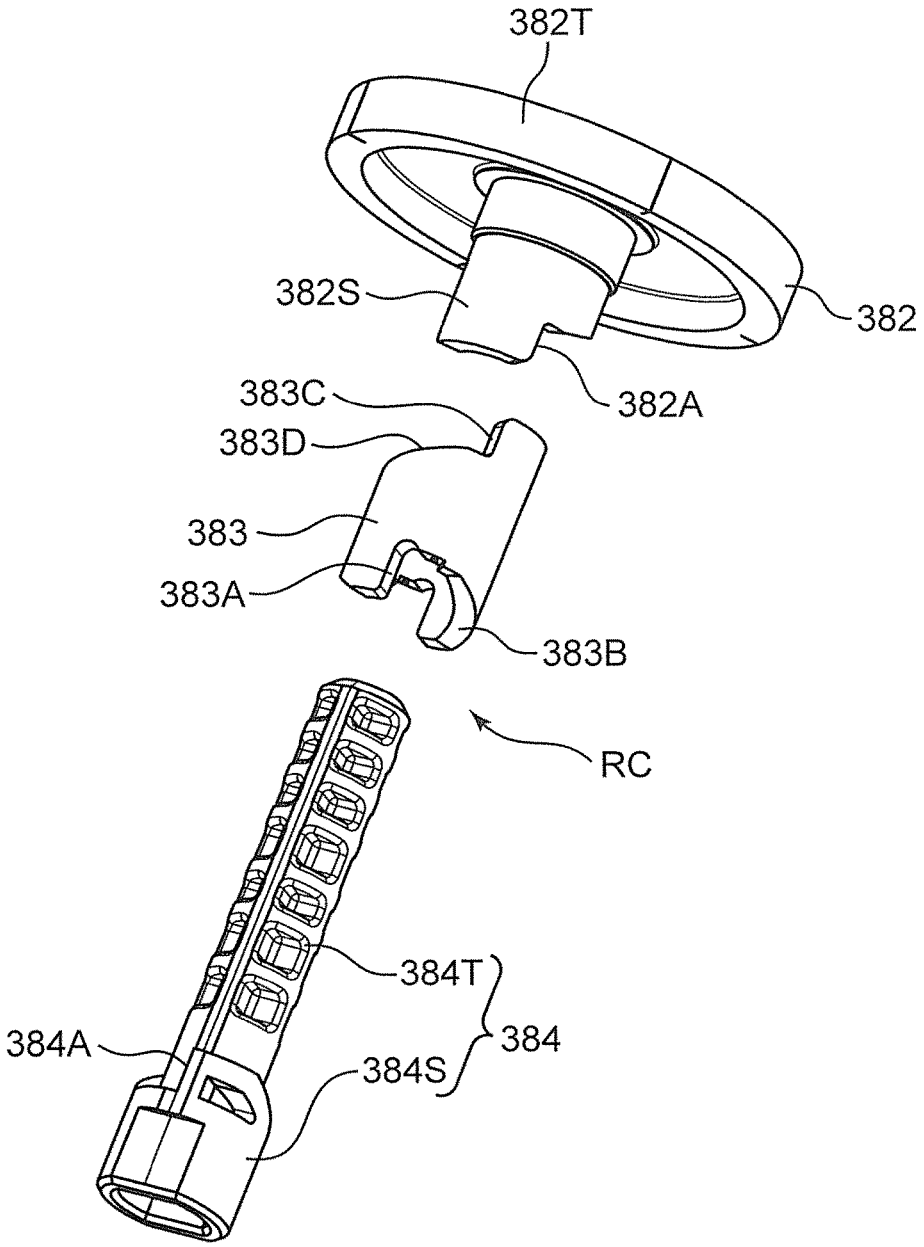
FIG. 19 is an exploded perspective view of the ratchet mechanism.
Figure 20:
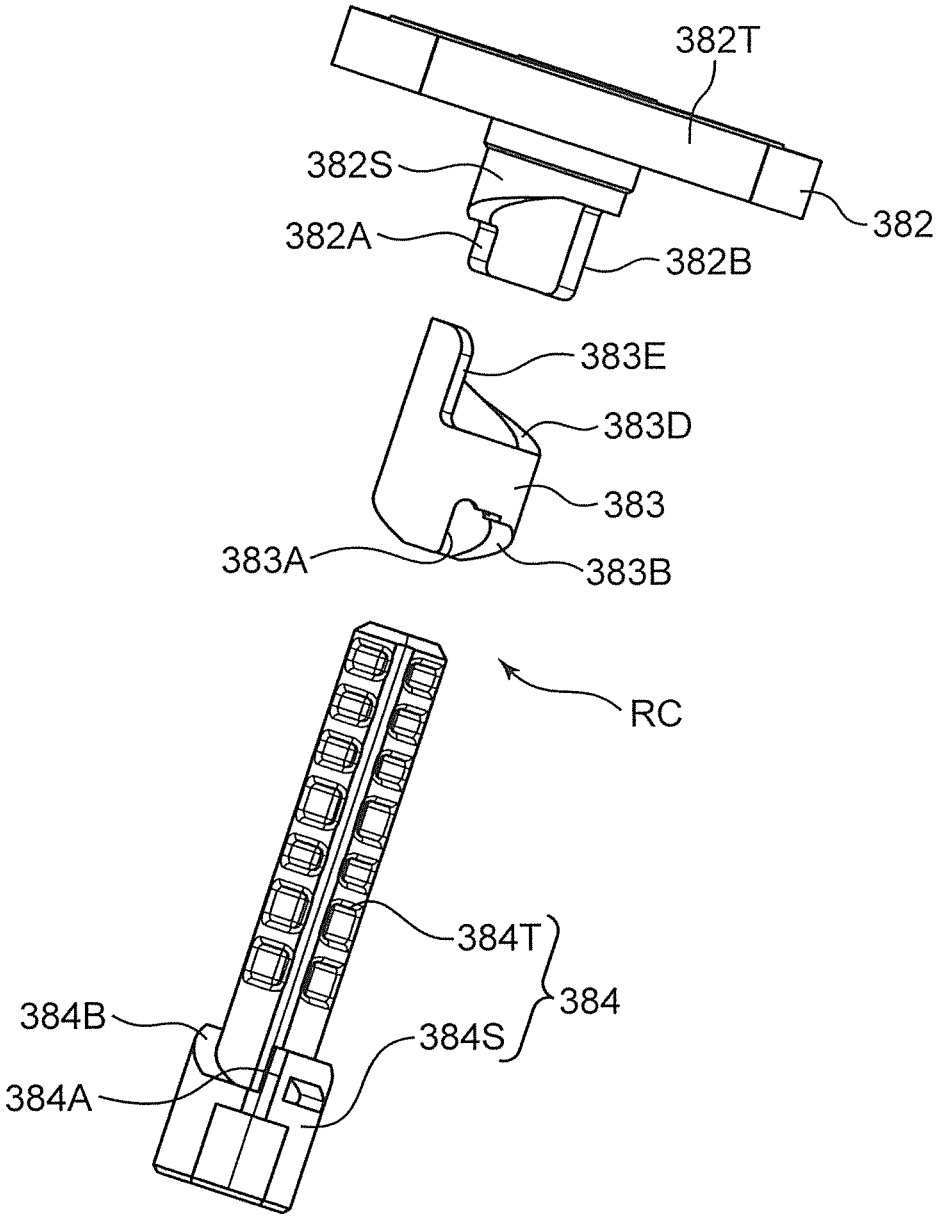
FIG. 20 is an exploded perspective view of the ratchet mechanism.
Figure 21:
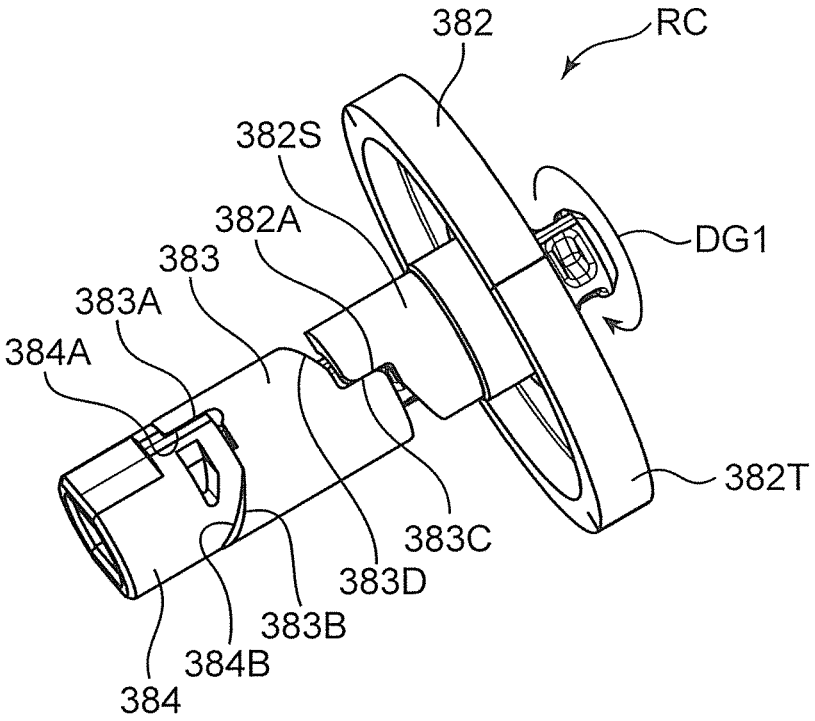
FIG. 21 is a perspective view of the ratchet mechanism.
Figure 22:
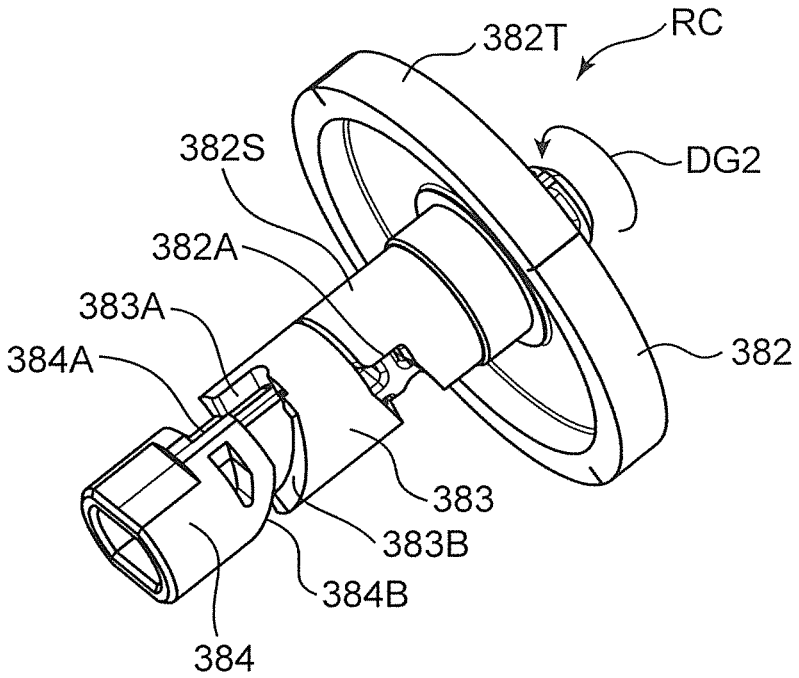
FIG. 22 is a perspective view of the ratchet mechanism.

Next, in addition to FIGS. 10 and 11, the ratchet mechanism RC provided in the toner container 30 will be described with reference to FIGS. 18 to 22. FIG. 18 is an exploded perspective view of the toner container 30. FIGS. 19 and 20 are exploded perspective views of the ratchet mechanism RC of the toner container 30. FIGS. 21 and 22 are perspective views of the ratchet mechanism RC of the toner container 30. In the present embodiment, the shaft driving gear 382, the ratchet gear 383, and the ratchet shaft 384 constitute the ratchet mechanism RC that transmits a rotational driving force to the shaft 33. The ratchet mechanism RC constitutes a part of the movable wall driving unit 41 of the container driving unit 40 (FIG. 6).

The shaft driving gear 382 constitutes a part of the movable wall driving unit 41. The shaft driving gear 382 is connected to the first shaft end 331 of the shaft 33, and transmits the driving force of the movable wall driving motor M1 (FIG. 6) to the shaft 33. The shaft driving gear 382 is disposed coaxially with the shaft 33. The shaft driving gear 382 is connected to the movable wall driving motor M1 via the third transmission gear 213. The shaft driving gear 382 can rotate the shaft 33 by being rotated by the driving force generated by the movable wall driving motor M1. As shown in FIG. 11, the right end of the shaft 33 is disposed so as to penetrate the rotating body 35. Also, the shaft driving gear 382 is connected (fixed) to the first shaft end 331 of the shaft 33 via the ratchet gear 383 and the ratchet shaft 384.

With reference to FIGS. 19 and 20, the shaft driving gear 382 has a cylinder 382S and a gear 382T which has a disc shape and is connected to the cylinder 382S. Gear teeth (not shown) are formed on an outer periphery of the gear 382T. A shaft 384T of the ratchet shaft 384 can be inserted through the cylinder 382S. The cylinder 382S has an engagement portion 382A extending in an axial direction of the ratchet shaft 384 (an axial direction of the shaft 33).

The ratchet gear 383 has a cylindrical shape, and the shaft 384T of the ratchet shaft 384 can be inserted through the ratchet gear 383. The ratchet gear 383 is disposed between the shaft 33 and the shaft driving gear 382 in the axial direction and is made rotatable around the axis of the shaft 33. The ratchet gear 383 has an engagement portion 383A extending in the axial direction of the ratchet shaft 384 and an inclined portion 383B opposed to the engagement portion 383A in the circumferential direction. Further, the ratchet gear 383 has an engagement portion 383C disposed on a side opposite to the engagement portion 383A and the inclined portion 383B in the axial direction and extending in the axial direction of the ratchet shaft 384, and has an inclined portion 383D opposed to the engagement portion 383C in the circumferential direction.

Further, the ratchet shaft 384 is disposed between the shaft driving gear 382 and the shaft 33 in the axial direction, and is capable of rotating integrally with the shaft 33. The ratchet shaft 384 has a base end 384S and the shaft 384T. The base end 384S is formed in a substantially cylindrical shape. An interior of a cylinder of the base end 384S has a pair of D-plane shapes. The first shaft end 331 (see FIG. 18) of the shaft 33 is inserted and engaged inside the base end 384S. As a result, the shaft 33 and the ratchet shaft 384 are integrally rotatable. The shaft 384T extends in the axial direction from the base end 384S. An outer diameter of the shaft 384T is smaller than an outer diameter of the base end 384S. An engagement portion 384A extending in the axial direction of the ratchet shaft 384 and an inclined portion 384B opposing the engagement portion 384A in the circumferential direction are provided at an end on the shaft 384T side of the base end 384S.

As illustrated in FIGS. 21 and 22, after the ratchet gear 383 is externally fitted to the ratchet shaft 384, the cylinder 382S of the shaft driving gear 382 is externally fitted to the ratchet shaft 384. As a result, in the circumferential direction around the ratchet shaft 384, the engagement portion 382A is disposed so as to face the engagement portion 383C, and the engagement portion 384A is disposed so as to face the engagement portion 383A. When the shaft driving gear 382 is rotated in a first rotating direction DG1 (see FIG. 21), the engagement portion 382A moves along the inclined portion 383D to axially press the ratchet gear 383 toward the base end 384S. Eventually, the engagement portion 382A comes into contact with the engagement portion 383C and presses the engagement portion 383C in the first rotating direction DG1.

Further, the engagement portion 383A contacts the engagement portion 384A to press the engagement portion 384A in the first rotating direction DG1. As a result, the shaft 33 connected to the ratchet shaft 384 rotates in the first rotating direction R1 (see FIG. 11). In other words, the pressing member 34 and the movable wall 32 move in the first direction DA. Note that the first rotating direction DG1 of the shaft driving gear 382 and the first rotating direction R1 of the shaft 33 are the same direction.

On the other hand, when the shaft driving gear 382 is rotated in a second rotating direction DG2 (see FIG. 22) opposite to the first rotating direction DG1, the engagement portion 382A is disposed away from the engagement portion 383C in the circumferential direction. Further, an engagement portion 382B of the shaft driving gear 382 presses an engagement portion 383E of the ratchet gear 383 in the second rotating direction DG2. As a result, the ratchet gear 383 rotates in the second rotating direction DG2. At this time, since the ratchet shaft 384 does not press the ratchet gear 383 toward the shaft 384T, engagement between the ratchet gear 383 and the ratchet shaft 384 (the engagement portion 384A) is released, and the ratchet gear 383 idly rotates in the second rotating direction DG2. As a result, a rotational force in the second rotating direction DG2 is not transmitted to the ratchet shaft 384, and as a result, the shaft 33 does not rotate in a second rotating direction R2 (see FIG. 11). In other words, as the shaft driving gear 382 rotates in the second rotating direction DG2, the pressing member 34 and the movable wall 32 are prevented from moving in the first direction DA. In addition, since the shaft 33 does not rotate in the second rotating direction R2, the pressing member 34 does not relatively move upstream in the first direction DA with respect to the movable wall 32. Therefore, even when a user erroneously rotates the shaft driving gear 382 in the second rotating direction R2 when the toner container 30 is detached from the developing device 20, the movable wall 32 is prevented from moving upstream in the first direction DA.

As described above, in the present embodiment, the ratchet mechanism RC including the shaft driving gear 382, the ratchet gear 383, and the ratchet shaft 384 transmits the rotational driving force of the shaft driving gear 382 in the first rotating direction DG1 to the shaft 33, and restricts transmission of the rotational driving force of the shaft driving gear 382 in the second rotating direction DG2 to the shaft 33.

<Control System of Image Forming Apparatus>

Figure 23:
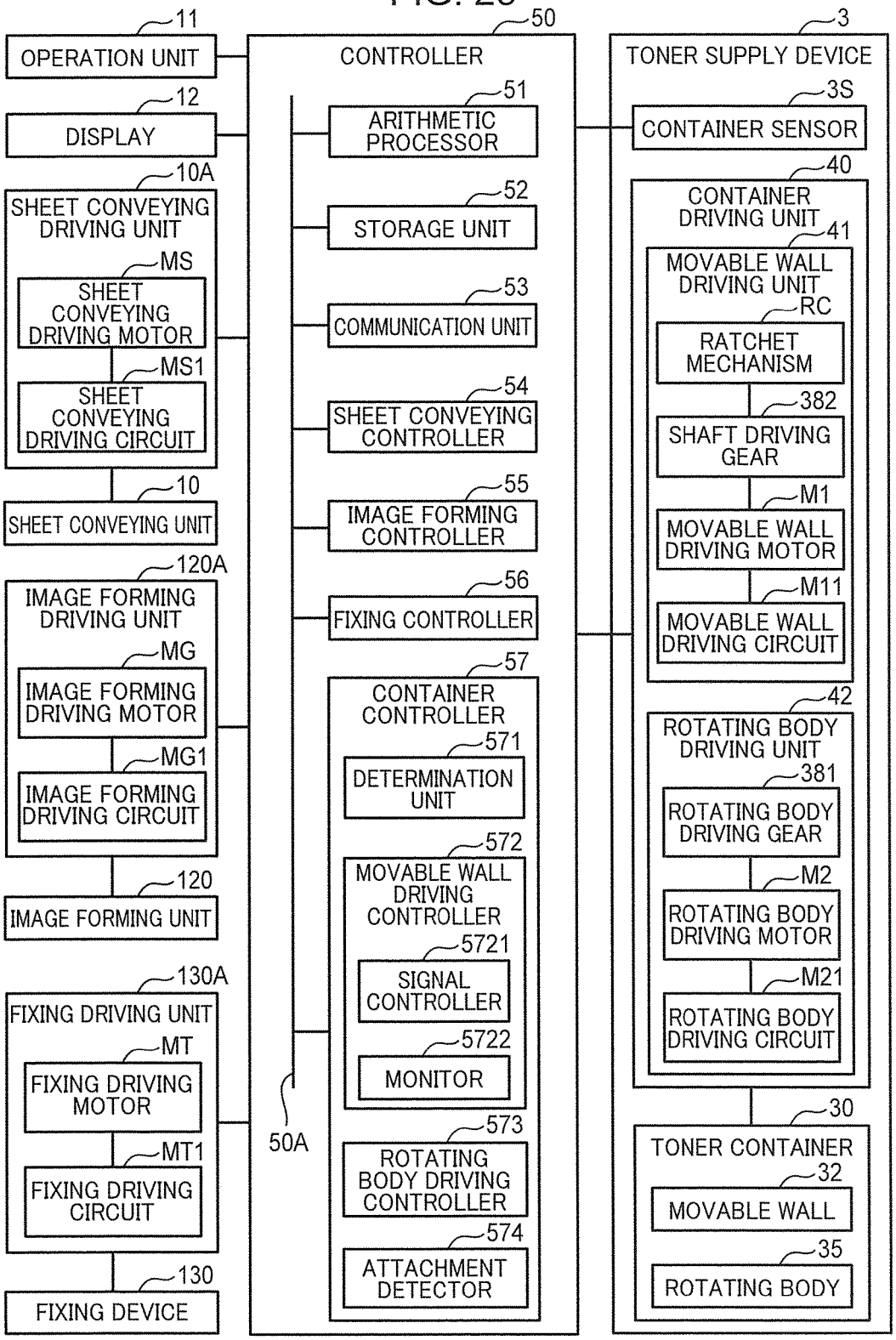
FIG. 23 is a block diagram showing a configuration of a control system of the image forming apparatus.

Next, a control system of the image forming apparatus 1 will be described with reference to a block diagram in FIG. 23. The image forming apparatus 1 includes, in addition to the toner supply device 3 including the container sensor 3S, the toner container 30, and the container driving unit 40, the sheet conveying unit 10, the image forming unit 120, and the fixing device 130, an operation unit 11, a display 12, a sheet conveying driving unit 10A, an image forming driving unit 120A, a fixing driving unit 130A, and a controller 50.

The operation unit 11 is an interface that is connected to the controller 50 so as to enable data communication and receives operation of a user. In the operation unit 11, for example, the user inputs image forming processing information on conditions of image forming processing including information, such as the number of printed sheets of the sheet S, and printing start instruction information indicating a start of printing. The display 12 is connected to the controller 50 so as to enable data communication and displays message information on image forming operation of the image forming apparatus 1 for notifying the user.

The sheet conveying driving unit 10A is a driving unit that operates the sheet conveying unit 10. The sheet conveying driving unit 10A includes a sheet conveying driving motor MS (a second driving motor) and a sheet conveying driving circuit MS1 (a second driving circuit). The sheet conveying driving motor MS is a driving motor for generating a driving force for operating the sheet conveying unit 10. The sheet conveying driving circuit MS1 is a driving circuit for controlling driving of the sheet conveying driving motor MS, and is connected to the controller 50 so as to enable data communication.

The image forming driving unit 120A is a driving unit for operating the photosensitive drum 121, the charger 122, the exposure device 123, the transfer roller 126, and the cleaning device 127 other than the developing device 20 and the toner supply device 3 in the image forming unit 120. Note that the toner container 30 of the toner supply device 3 is driven by the container driving unit 40. Further, the developing roller 21, the first stirring screw 23, and the second stirring screw 24 of the developing device 20 are driven by the rotating body driving unit 42 of the container driving unit 40 so as to be synchronized with driving of the rotating body 35 of the toner container 30. The image forming driving unit 120A includes an image forming driving motor MG and an image forming driving circuit MG1. The image forming driving motor MG is a driving motor that generates a driving force to operate the photosensitive drum 121, the charger 122, the exposure device 123, the transfer roller 126, and the cleaning device 127 of the image forming unit 120. The image forming driving circuit MG1 is a driving circuit that controls driving of the image forming driving motor MG, and is connected to the controller 50 so as to enable data communication.

The fixing driving unit 130A is a driving unit that operates the fixing device 130. The fixing driving unit 130A includes a fixing driving motor MT and a fixing driving circuit MT1. The fixing driving motor MT is a driving motor that generates a driving force to operate the fixing device 130. The fixing driving circuit MT1 is a driving circuit that controls driving of the fixing driving motor MT, and is connected to the controller 50 so as to enable data communication.

The container driving unit 40 of the toner supply device 3 includes the movable wall driving unit 41 and the rotating body driving unit 42. In addition to the shaft driving gear 382 and the ratchet mechanism RC, the movable wall driving unit 41 includes the movable wall driving motor M1 (the first driving motor) and a movable wall driving circuit M11 (a first driving circuit). The movable wall driving motor M1 is a driving motor that generates a driving force for rotating the shaft 33 of the toner container 30. The driving force generated by the movable wall driving motor M1 is transmitted to the shaft 33 via the third transmission gear 213, the shaft driving gear 382, and the ratchet mechanism RC. As a result, the shaft 33 rotates in the first rotating direction R1. The movable wall 32 moves in the first direction DA along the shaft 33 as the shaft 33 rotates in the first rotating direction R1. The movable wall driving circuit M11 is a driving circuit for controlling driving of the movable wall driving motor M1, and is connected to the controller 50 so as to enable data communication.

In addition to the rotating body driving gear 381, the rotating body driving unit 42 includes the rotating body driving motor M2 and a rotating body driving circuit M21. The rotating body driving motor M2 is a driving motor for generating a driving force for rotating the rotating body 35 of the toner container 30. The driving force generated by the rotating body driving motor M2 is transmitted to the rotating body 35 via the first transmission gear 211, the second transmission gear 212, and the rotating body driving gear 381. As a result, the rotating body 35 rotates around the shaft 33. The rotating body driving circuit M21 is a driving circuit for controlling driving of the rotating body driving motor M2, and is connected to the controller 50 so as to enable data communication. Note that the driving force generated by the rotating body driving motor M2 is also transmitted to the developing roller 21, the first stirring screw 23, and the second stirring screw 24 of the developing device 20 via the first transmission gear 211. Thereby, the developing roller 21, the first stirring screw 23, and the second stirring screw 24 of the developing device 20 rotate.

The controller 50 includes an arithmetic processor 51 that comprehensively controls operation of the image forming apparatus 1, a storage unit 52 that stores an image forming program and the like, a communication unit 53, a sheet conveying controller 54, an image forming controller 55, a fixing controller 56, and a container controller 57.

The arithmetic processor 51 is a computer composed of a CPU and a memory, and is connected to the storage unit 52, the communication unit 53, the sheet conveying controller 54, the image forming controller 55, the fixing controller 56, and the container controller 57 via a bus 50A. The arithmetic processor 51 executes image forming processing based on the image forming program stored in the storage unit 52 and executes various arithmetic processing associated therewith.

In addition to the image forming program, the storage unit 52 stores a reference threshold value relating to the number of outputs of the H signal output from the container sensor 3S used by a determination unit 571 of the container controller 57 to be described later.

The communication unit 53 is an interface for performing data communication with the operation unit 11, the display 12, and the container sensor 3S.

The sheet conveying controller 54 is connected to the sheet conveying driving circuit MS1 so as to enable data communication, and transmits a control signal related to drive control of the sheet conveying driving motor MS to the sheet conveying driving circuit MS1. When the communication unit 53 receives the image forming processing information input to the operation unit 11, the sheet conveying controller 54 transmits a control signal corresponding to the image forming processing information to the sheet conveying driving circuit MS1. Upon receiving the control signal transmitted from the sheet conveying controller 54, the sheet conveying driving circuit MS1 controls driving of the sheet conveying driving motor MS in accordance with the control signal.

The image forming controller 55 is connected to the image forming driving circuit MG1 so as to enable data communication, and transmits a control signal related to drive control of the image forming driving motor MG to the image forming driving circuit MG1. When the communication unit 53 receives the image forming processing information input to the operation unit 11, the image forming controller 55 transmits a control signal corresponding to the image forming processing information to the image forming driving circuit MG1. Upon receiving the control signal transmitted from the image forming controller 55, the image forming driving circuit MG1 controls driving of the image forming driving motor MG according to the control signal.

The fixing controller 56 is connected to the fixing driving circuit MT1 so as to enable data communication, and transmits a control signal related to drive control of the fixing driving motor MT to the fixing driving circuit MT1. When the communication unit 53 receives the image forming processing information input to the operation unit 11, the fixing controller 56 transmits a control signal corresponding to the image forming processing information to the fixing driving circuit MT1. Upon receiving the control signal transmitted from the fixing controller 56, the fixing driving circuit MT1 controls driving of the fixing driving motor MT in accordance with the control signal.

The container controller 57 constitutes a part of the toner supply device 3. The container controller 57 includes the determination unit 571, a movable wall driving controller 572, a rotating body driving controller 573, and an attachment detector 574.

The rotating body driving controller 573 is connected to the rotating body driving circuit M21 so as to enable data communication, and transmits a control signal related to drive control of the rotating body driving motor M2 to the rotating body driving circuit M21. When the communication unit 53 receives the image forming processing information input to the operation unit 11, the rotating body driving controller 573 transmits a control signal corresponding to the image forming processing information to the rotating body driving circuit M21. Upon receiving the control signal transmitted from the rotating body driving controller 573, the rotating body driving circuit M21 controls driving of the rotating body driving motor M2 in accordance with the control signal.

Figure 24A:
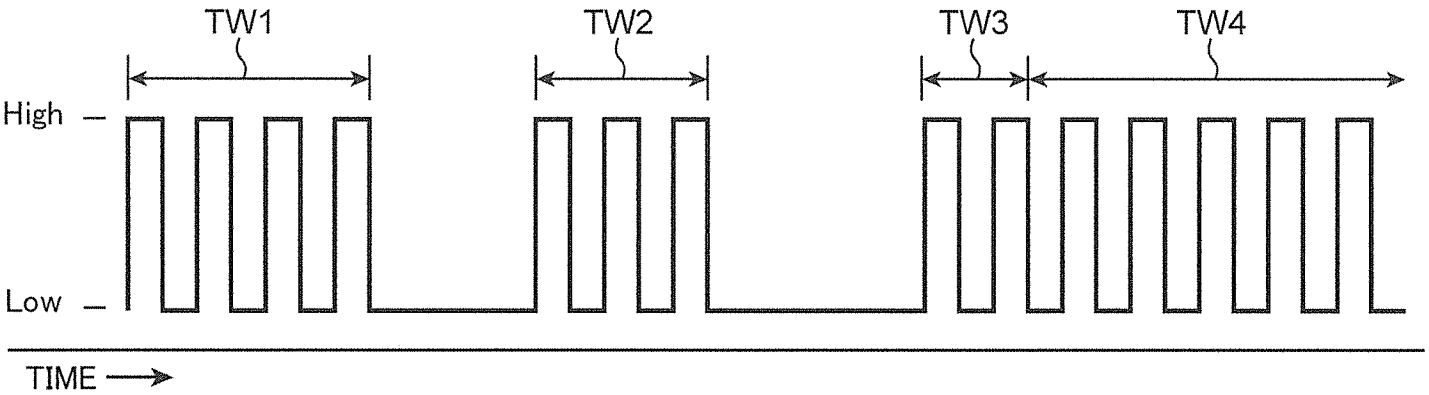
FIGS. 24A and 24B each are a diagram for describing an output signal of a detection sensor provided in the developer supply device.
Figure 24B:
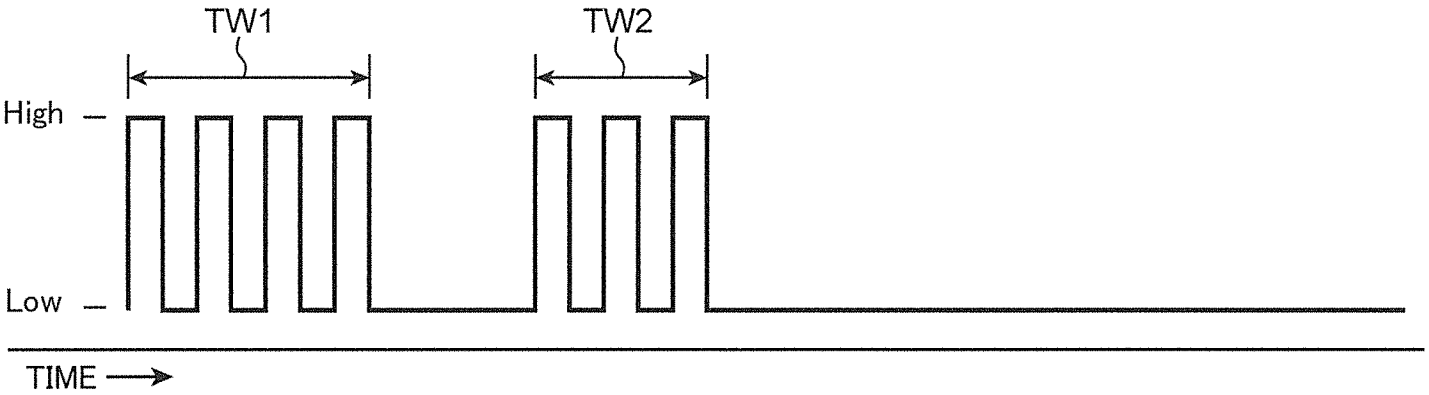

When the rotating body 35 of the toner container 30 rotates by driving of the rotating body driving motor M2, the communication unit 53 receives the output signal output from the container sensor 3S. The output signal of this container sensor 3S will be described with reference to FIGS. 24A and 24B. FIGS. 24A and 24B schematically show output signals output from the container sensor 3S when one rotation of the rotating body 35 is taken as one cycle. FIG. 24A shows an output signal output from the container sensor 3S when the toner exists above the specific region 37K1 on the inner peripheral surface 37K of the container main body 37. In other words, FIG. 24A shows the output signal of the container sensor 3S in a case where a draft surface of the toner contained in the storage space 37S of the container main body 37 is located above the specific region 37K1. On the other hand, FIG. 24B shows an output signal of the container sensor 3S in a case where the draft surface of the toner contained in the storage space 37S is located below the specific region 37K1 or in a case where the toner is in an empty state (a vacant state) in the storage space 37S.

At predetermined time intervals (for example, 48 msec) during one cycle which is one rotation of the rotating body 35, the container sensor 3S outputs the H signal (the High signal) or the L signal (the Low signal) in accordance with a change in the magnetic field in the storage space 37S of the container main body 37.

Referring to FIG. 24(1), when the draft surface of the toner contained in the storage space 37S is located above the specific region 37K1, in a time period TW1 during which the cleaning member 361 passes through the specific region 37K1 on the peripheral surface 37K of the container main body 37 during rotation of the rotating body 35, the container sensor 3S outputs a plurality of H signals. The toner is attached to the cleaning member 361. Therefore, the container sensor 3S outputs the H signal by detecting a magnetic field having a strength equal to or greater than the predetermined value caused by the toner attached to the cleaning member 361.

In a time period TW2 during which the second support projecting piece 35E passes through the specific region 37K1 during rotation of the rotating body 35, the container sensor 3S outputs a plurality of H signals. The attachment detection member 362 is affixed to the second support projecting piece 35E. Therefore, the container sensor 3S outputs the H signal by detecting a magnetic field having a strength equal to or greater than the predetermined value caused by the attachment detection member 362.

In a time period TW3 during which the stirring blade 35B passes through the specific region 37K1 during rotation of the rotating body 35, the container sensor 3S outputs a plurality of H signals. When the draft surface of the toner contained in the storage space 37S of the container main body 37 is located above the specific region 37K1, the toner exists around the stirring blade 35B. Therefore, the container sensor 3S outputs the H signal by detecting a magnetic field having a strength equal to or greater than the predetermined value caused by the toner existing around the stirring blade 35B.

In a time period TW4 during which the cutout portion 35AA of the plate 35A passes through the specific region 37K1 during rotation of the rotating body 35, the container sensor 3S outputs a plurality of H signals. When the draft surface of the toner is located above the specific region 37K1, the toner exists around the cutout portion 35AA of the plate 35A. Therefore, the container sensor 3S outputs the H signal by detecting a magnetic field having a strength equal to or greater than the predetermined value caused by the toner existing around the cutout portion 35AA.

On the other hand, referring to FIG. 24B, when the draft surface of the toner contained in the storage space 37S is located below the specific region 37K1 or when the toner is in the empty state in the storage space 37S, in the time period TW1 during which the cleaning member 361 passes through the specific region 37K1 during rotation of the rotating body 35, the container sensor 3S outputs a plurality of H signals. A reason why the container sensor 3S outputs the H signal despite a fact that the draft surface of the toner contained in the storage space 37S is located below the specific region 37K1 is that the container sensor 3S detects a magnetic field having a strength equal to or greater than the predetermined value caused by the toner attached to the cleaning member 361.

In the time period TW2 during which the second support projecting piece 35E passes through the specific region 37K1 during rotation of the rotating body 35, the container sensor 3S outputs a plurality of H signals. A reason why the container sensor 3S outputs the H signal despite the fact that the draft surface of the toner contained in the storage space 37S is located below the specific region 37K1 is that the container sensor 3S detects a magnetic field having a strength equal to or greater than the predetermined value caused by the attachment detection member 362 affixed to the second support projecting piece 35E. In other words, regardless of a position of the draft surface of the toner with respect to the specific region 37K1, the container sensor 3S detects the attachment detection member 362, whereby the container sensor 3S outputs the H signal.

In the time period during which the stirring blade 35B passes through the specific region 37K1 during rotation of the rotating body 35, the container sensor 3S outputs an L signal. When the draft surface of the toner contained in the storage space 37S is located below the specific region 37K1, the toner does not exist around the stirring blade 35B. For this reason, a strength of a magnetic field in the storage space 37S is less than the predetermined value, so that the container sensor 3S outputs the L signal.

The container sensor 3S outputs an L signal in the time period during which the cutout portion 35AA of the plate 35A passes through the specific region 37K1 during rotation of the rotating body 35. When the draft surface of the toner contained in the storage space 37S is located below the specific region 37K1, the toner does not exist around the cutout portion 35AA of the plate 35A. For this reason, a strength of a magnetic field in the storage space 37S is less than the predetermined value, so that the container sensor 3S outputs the L signal.

The attachment detector 574 of the container controller 57 detects attachment of the toner container 30 to the developing device 20 based on the output signal output from the container sensor 3S. Specifically, when the rotating body 35 rotates, in the time period TW2 during which the second support projecting piece 35E on which the attachment detection member 362 is affixed passes through the specific region 37K1, the attachment detector 574 detects attachment of the toner container 30 to the developing device 20 based on the H signal output from the container sensor 3S. As described above, regardless of the position of the draft surface of the toner with respect to the specific region 37K1, the container sensor 3S detects the attachment detection member 362, whereby the container sensor 3S outputs the H signal. Therefore, during one rotation of the rotating body 35, when the H signal derived from the attachment detection member 362 is output from the container sensor 3S, the attachment detector 574 can detect that the toner container 30 is mounted to the developing device 20.

Note that in a case where the toner container 30 is not mounted to the developing device 20, even if the rotating body driving motor M2 is driven, the container sensor 3S does not output the H signal derived from the attachment detection member 362. In such a case, the attachment detector 574 transmits message information (container non-attachment message information) indicating that the toner container 30 is not mounted to the developing device 20 to the display 12 via the communication unit 53. Consequently, the container non-attachment message information is displayed on the display 12. A user can confirm that the toner container 30 is not mounted to the developing device 20 by the container non-attachment message information displayed on the display 12.

The determination unit 571 of the container controller 57 refers to the reference threshold value stored in the storage unit 52 and determines the number of outputs of the H signal output from the container sensor 3S. In a plurality of output signals output from the container sensor 3S at predetermined time intervals during one cycle which is one rotation of the rotating body 35, the determination unit 571 determines whether or not the number of outputs of the H signal is less than the reference threshold value. The determination unit 571 outputs first determination information when the number of outputs of the H signal is less than the reference threshold value and outputs second determination information when the number of outputs of the H signal is equal to or greater than the reference threshold value. When the determination unit 571 outputs the first determination information, the draft surface of the toner contained in the storage space 37S is located below the specific region 37K1. On the other hand, when the determination unit 571 outputs the second determination information, the draft surface of the toner is positioned above the specific region 37K1.

The movable wall driving controller 572 of the container controller 57 is connected to the movable wall driving circuit M11 so as to enable data communication, and includes a signal controller 5721 and a monitor 5722.

The signal controller 5721 transmits a control signal related to drive control of the movable wall driving motor M1 to the movable wall driving circuit M11 based on the determination information output from the determination unit 571. When the first determination information is output from the determination unit 571, the signal controller 5721 transmits a drive permission signal, which is a control signal that permits drive control of the movable wall driving motor M1, to the movable wall driving circuit M11. On the other hand, when the second determination information is output from the determination unit 571, the signal controller 5721 transmits a drive non-permission signal, which is a control signal to disable drive control of the movable wall driving motor M1, to the movable wall driving circuit M11. Details regarding the transmission of the control signal to the movable wall driving circuit M11 of the signal controller 5721 will be described later.

The monitor 5722 monitors a driving state of the sheet conveying driving motor MS under the control of the sheet conveying driving circuit MS1. Furthermore, when the signal controller 5721 transmits the drive permission signal to the movable wall driving circuit M11, the monitor 5722 monitors control of the movable wall driving circuit M11 with respect to the movable wall driving motor M1 so as to perform control to drive the movable wall driving motor M1 within a driving time of the sheet conveying driving motor MS. Details of monitoring operation of the monitor 5722 will be described later.

The movable wall driving controller 572 controls movement of the movable wall 32 based on the determination information output from the determination unit 571, whereby the toner supply control (developer supply control), which is control relating to supply of the toner from the toner container 30 to the developing device 20, is executed. Further, the movable wall driving controller 572 controls the movement of the movable wall 32 based on the determination information output from the determination unit 571, whereby toner empty control (developer empty control), which is control in a case where the toner contained in the storage space 37S of the container main body 37 is in the empty state, is executed.

Figure 25A:
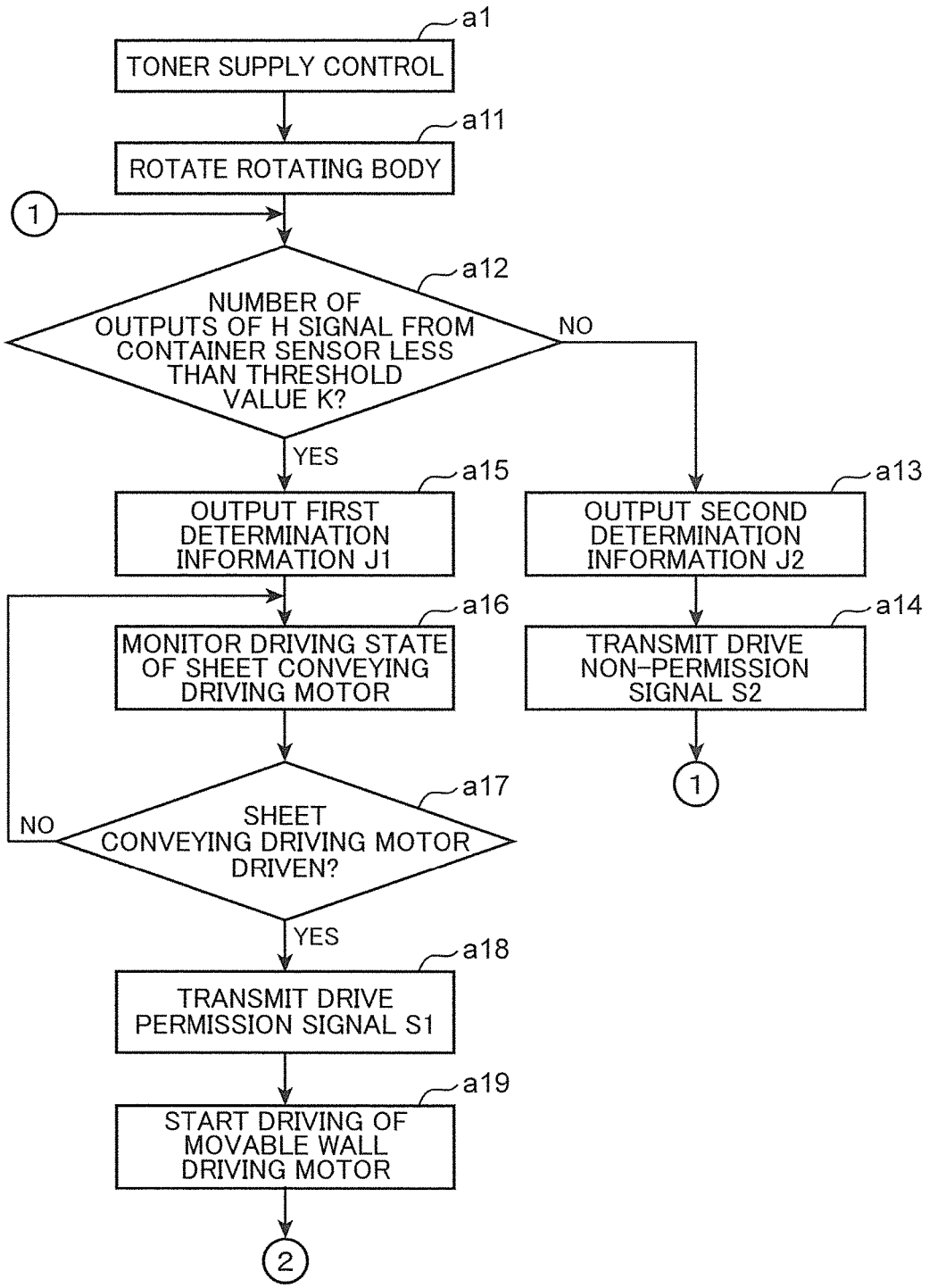
FIG. 25A is a flowchart showing developer supply control operation in the developer supply device.
Figure 25B:
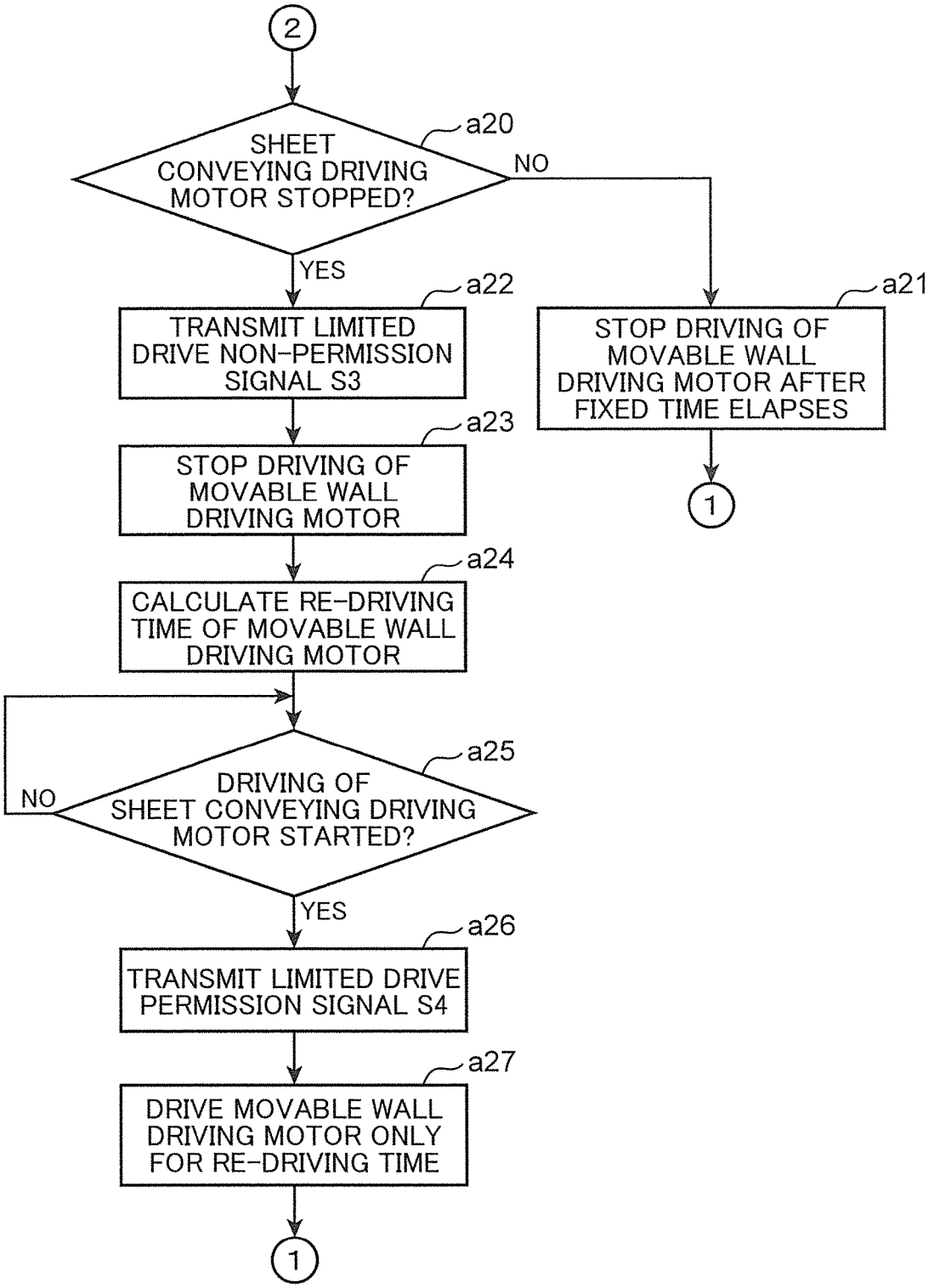
FIG. 25B is a flowchart showing the developer supply control operation in the developer supply device.
Figure 26:
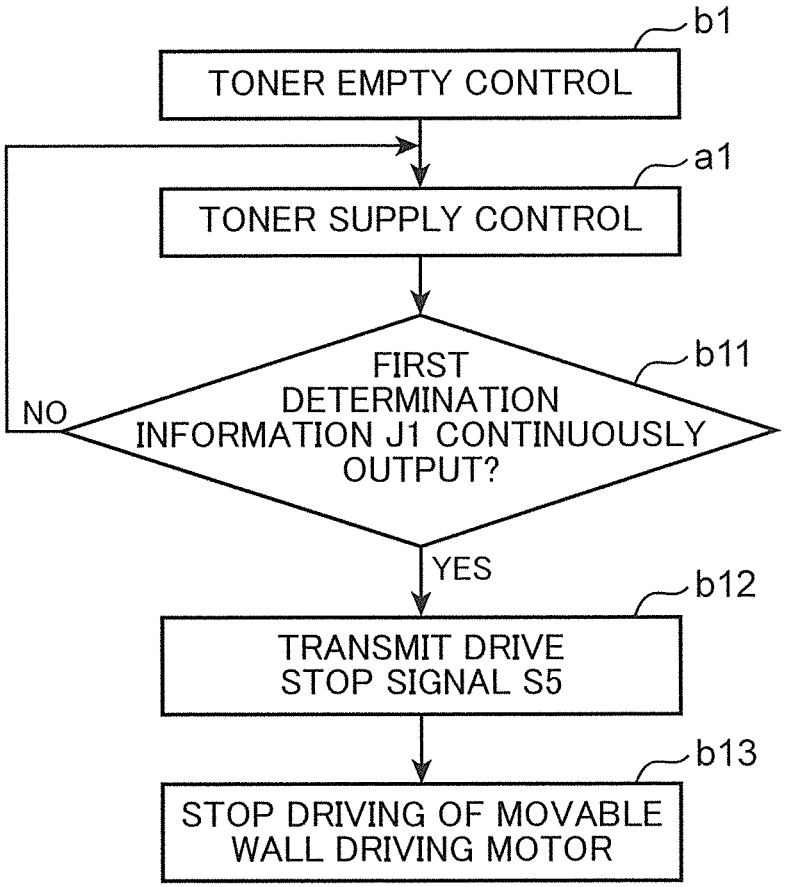
FIG. 26 is a flowchart showing developer empty control operation in the developer supply device.
Figure 27:
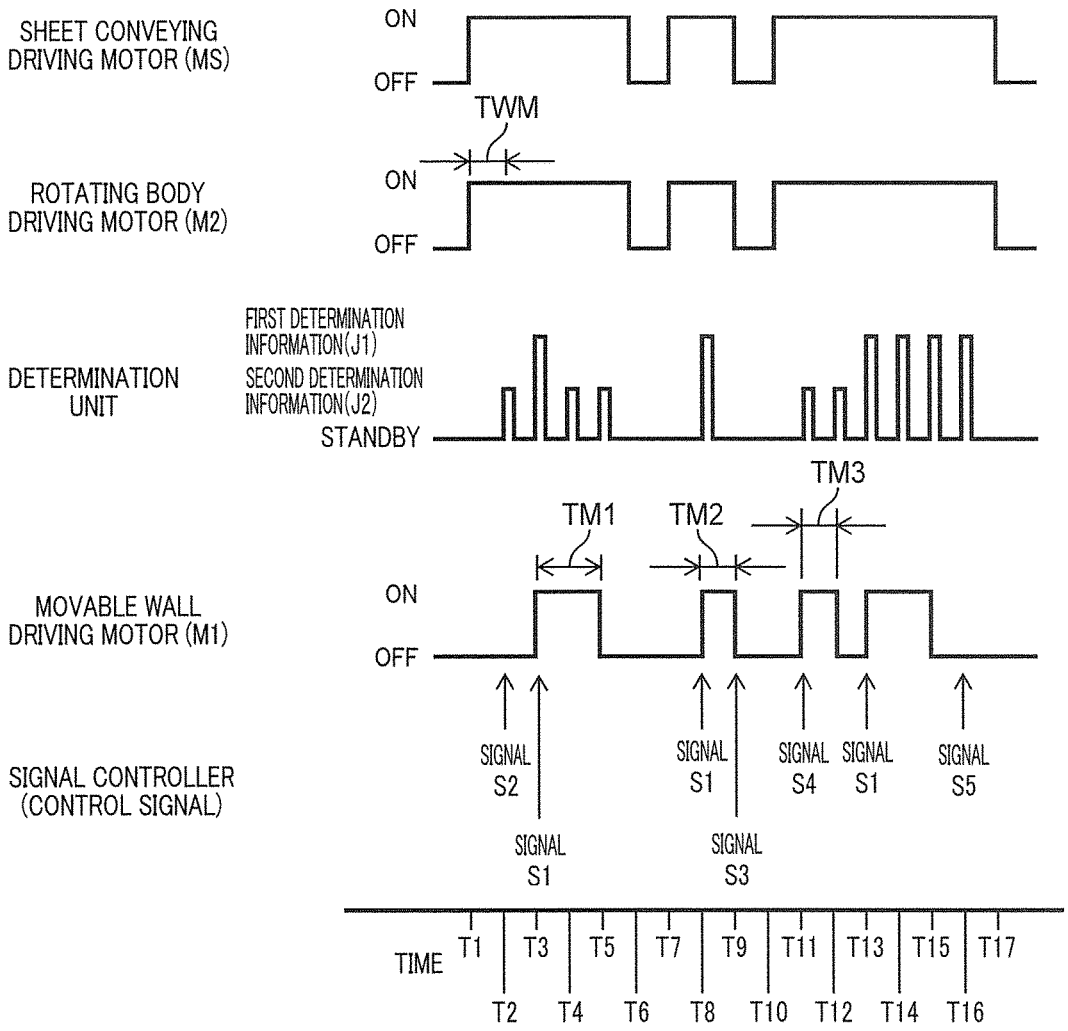
FIG. 27 is a diagram for describing the developer supply control operation and the developer empty control operation in the developer supply device.

The toner supply control and the toner empty control executed by the movable wall driving controller 572 will be described as follows with reference to FIGS. 25A, 25B, 26, and 27. FIGS. 25A and 25B are flowcharts showing the toner supply control. FIG. 26 is a flowchart showing the toner empty control. FIG. 27 is a diagram for describing the toner supply control and the toner empty control.

(About Toner Supply Control)

While the first guide portion 312 of the lid 31 and the second guide portion 391 of the cover 39 are guided by the pair of left guide groove 201L and the right guide groove 201R of the developing device 20, the toner container 30 is mounted to the container attachment portion 109 by a user (see FIGS. 6 and 7). When the toner container 30 is mounted to the container attachment portion 109, the container shutter 30S is moved and the toner discharge port 377 is opened. As a result, the toner discharge port 377 is disposed oppositely above the toner supply port 25 (see FIGS. 4 and 5).

In the present embodiment, as shown in FIG. 5, the volume replenishment type toner supply method is adopted. Therefore, when the accumulation portion 29 on the developing device 20 side seals the toner supply port 25 from below, the replenishment toner does not fall from the toner container 30.

When the communication unit 53 receives the image forming processing information input to the operation unit 11, the image forming operation of the image forming apparatus 1 is started. Specifically, the sheet conveying controller 54 transmits a control signal to the sheet conveying driving circuit MS1, the image forming controller 55 transmits a control signal to the image forming driving circuit MG1, the fixing controller 56 transmits a control signal to the fixing driving circuit MT1, and the rotating body driving controller 573 transmits a control signal to the rotating body driving circuit M21. As a result, driving of each of the sheet conveying driving motor MS, the image forming driving motor MG, the fixing driving motor MT, and the rotating body driving motor M2 is started (time T1 in FIG. 27).

When the rotating body driving motor M2 is driven, the rotating body 35 of the toner container 30 rotates around the shaft 33 (step a11 in FIG. 25A). Further, when the rotating body driving motor M2 is driven, the toner is supplied from the developing roller 21 of the developing device 20 to the photosensitive drum 121.

During one cycle TWM (see FIG. 27) represented by a time period in which the rotating body 35 makes one rotation (a time period from time T1 to time T2 in FIG. 27), the determination unit 571 determines whether the number of outputs of the H signal output from the container sensor 3S is less than a reference threshold value K (step a12 in FIG. 25A). When the number of outputs of the H signal is equal to or greater than the reference threshold value K, the determination unit 571 outputs second determination information J2 (step a13 in FIG. 25A, time T2 in FIG. 27).

When the second determination information J2 is output from the determination unit 571, the signal controller 5721 of the movable wall driving controller 572 transmits a drive non-permission signal S2, which does not permit drive control of the movable wall driving motor M1, to the movable wall driving circuit M11 (step a14 in FIG. 25A, time T2 in FIG. 27). Upon receiving the drive non-permission signal S2 transmitted from the signal controller 5721, the movable wall driving circuit M11 does not drive the movable wall driving motor M1. Therefore, the movable wall 32 does not move.

When the driving of the rotating body driving motor M2 continues and the toner continues to be supplied from the developing roller 21 of the developing device 20 to the photosensitive drum 121, the toner in the accumulation portion 29 on the developing device 20 side decreases. Therefore, the toner contained in the storage space 37S of the container main body 37 flows into the developing device 20 from the toner discharge port 377 via the toner supply port 25. At this time, the rotating body 35 is rotated by the driving of the rotating body driving motor M2. As a result, the stirring blade 35B provided on the rotating body 35 revolves around the shaft 33 above the toner discharge port 377, so that the toner above the toner discharge port 377 is stably stirred. As a result, flowability of the toner in the storage space 37S increases, and the toner falls stably from the toner discharge port 377.

When the toner falls from the toner discharge port 377 in accordance with the reduction of the toner in the accumulation portion 29 on the developing device 20 side, the toner contained in the storage space 37S of the container main body 37 decreases, and the draft surface of the toner is located below the specific region 37K1 (a time period from time T2 to time T3 in FIG. 27). In this case, the number of outputs of the H signal output from the container sensor 3S is less than the reference threshold value K, and the determination unit 571 outputs first determination information J1 (step a15 in FIG. 25A, time T3 in FIG. 27). As described above, based on the number of outputs of the H signal output from the container sensor 3S during the one cycle TWM in which the rotating body 35 makes one rotation, the determination unit 571 determines a reduction state of the toner contained in the storage space 37S. Therefore, the determination unit 571 can determine the reduction state of the toner in the storage space 37S with high accuracy.

When the first determination information J1 is output from the determination unit 571, the monitor 5722 monitors the driving state of the sheet conveying driving motor MS (step a16 in FIG. 25A) and determines whether the sheet conveying driving motor MS is driven (step a17 in FIG. 25A).

When the monitor 5722 determines that the sheet conveying driving motor MS is driven, the signal controller 5721 transmits a drive permission signal S1, which permits drive control of the movable wall driving motor M1, to the movable wall driving circuit M11 (step a18 in FIG. 25A, time T3 in FIG. 27). As a result, the movable wall driving controller 572 can perform control to drive the movable wall driving motor M1 within the driving time of the sheet conveying driving motor MS under the control of the sheet conveying driving circuit MS1.

When the movable wall driving circuit M11 receives the drive permission signal S1 transmitted from the signal controller 5721, the movable wall driving circuit M11 drives the movable wall driving motor M1 in accordance with the drive permission signal S. In the present embodiment, upon receiving the drive permission signal S1 transmitted from the signal controller 5721, the movable wall driving circuit M11 drives the movable wall driving motor M1 at a predetermined constant speed and for a fixed time TM1 (a time from time T3 to time T5 in FIG. 27) (step a19 in FIG. 25A).

The driving force generated by the movable wall driving motor M1 is transmitted to the shaft 33 via the third transmission gear 213, the shaft driving gear 382, and the ratchet mechanism RC. As a result, the shaft 33 rotates in the first rotating direction R1. As the shaft 33 rotates in the first rotating direction R1, the movable wall 32 moves in the first direction DA along the shaft 33, and the toner in the storage space 37S of the container main body 37 is conveyed toward the toner discharge port 377. In this manner, the movable wall 32 is moved based on the drive permission signal S1 transmitted from the signal controller 5721 according to the first determination information J1 of the determination unit 571. Therefore, the movement of the movable wall 32 becomes appropriate according to the reduction state of the toner contained in the storage space 37S of the container main body 37.

When the movable wall 32 moves in the first direction DA and conveys the toner toward the toner discharge port 377, a volume of the storage space 37S of the container main body 37 is reduced. Therefore, the draft surface of the toner contained in the storage space 37S of the container main body 37 is located above the specific region 37K1 (a time period from time T3 to time T5 in FIG. 27). In this case, the number of outputs of the H signal output from the container sensor 3S is equal to or greater than the reference threshold value K, and the determination unit 571 outputs the second determination information J2 (times T4, T5 in FIG. 27).

While the movable wall driving motor M1 is driven under the control of the movable wall driving circuit M11 in accordance with the drive permission signal S1 of the signal controller 5721, the monitor 5722 determines whether the sheet conveying driving motor MS has stopped (step a20 in FIG. 25B).

When the monitor 5722 determines that the sheet conveying driving motor MS is not stopped, the driving of the movable wall driving motor M1 is continued under the control of the movable wall driving circuit M11 according to the drive permission signal S1. After the fixed time TM1 elapses, the movable wall driving motor M1 stops driving (step a21 in FIG. 25B, time T5 in FIG. 27).

In the example shown in FIG. 27, after the movable wall driving motor M1 stops driving at time T5, the image forming operation of the image forming apparatus 1 is temporarily terminated at time T6, and the sheet conveying driving motor MS and the rotating body driving motor M2 stop driving. Thereafter, at time T7, the image forming operation of the image forming apparatus 1 is restarted, and driving of the sheet conveying driving motor MS and the rotating body driving motor M2 is started. Then, in response to the first determination information J1 output from the determination unit 571 at time T8, the signal controller 5721 transmits the drive permission signal S1 to the movable wall driving circuit M11. While the movable wall driving motor M1 is driven under the control of the movable wall driving circuit M11 in accordance with the drive permission signal S1 of the signal controller 5721, the monitor 5722 determines whether the sheet conveying driving motor MS has stopped (step a20 in FIG. 25B).

When the monitor 5722 determines that the sheet conveying driving motor MS has stopped (time T9 in FIG. 27), the signal controller 5721 transmits a limited drive non-permission signal S3 to the movable wall driving circuit M11 (step a22 in FIG. 25B, time T9 in FIG. 27). The limited drive non-permission signal S3 is a control signal that cancels the drive permission signal S1 corresponding to the first determination information J1 of the determination unit 571 and does not permit drive control of the movable wall driving motor M1 to a limited extent. Upon receiving the limited drive non-permission signal S3 transmitted from the signal controller 5721, the movable wall driving circuit M11 stops driving the movable wall driving motor M1 before the lapse of the fixed time TM1 (step a23 in FIG. 25B, time T9 in FIG. 27). Therefore, the movement of the movable wall 32 is stopped.

When the limited drive non-permission signal S3 is transmitted from the signal controller 5721 to the movable wall driving circuit M11, the monitor 5722 monitors a driving time TM2 of the movable wall driving motor M1 (a time from time T8 to time T9 in FIG. 27) within the driving time of the sheet conveying driving motor MS (the time from time T7 to time T9 in FIG. 27). When the driving time TM2 of the movable wall driving motor M1 is shorter than the fixed time TM1, the monitor 5722 calculates a re-driving time TM3 as a difference value of each time (step a24 in FIG. 25B).

Further, the monitor 5722 determines whether or not driving of the sheet conveying driving motor MS is started (step a25 in FIG. 25B).

When the monitor 5722 calculates the re-driving time TM3 and determines that driving of the sheet conveying driving motor MS is started (time T10 in FIG. 27), regardless of the information output from the determination unit 571, the signal controller 5721 transmits a limited drive permission signal S4 to the movable wall driving circuit M11 in preference to the transmission of the drive permission signal S1 and the drive non-permission signal S2 (step a26 in FIG. 25B, time T11 in FIG. 27). The limited drive permission signal S4 is a control signal that permits drive control of the movable wall driving motor M1 for a time corresponding to the re-driving time TM3 within the driving time of the sheet conveying driving motor MS.

Upon receiving the limited drive permission signal S4 transmitted from the signal controller 5721, the movable wall driving circuit M11 drives the movable wall driving motor M1 in response to the limited drive permission signal S4 for a time corresponding to the re-driving time TM3 (step a27 in FIG. 25B, a time period from time T11 to time T12 in FIG. 27). As a result, the movable wall 32 moves for a time corresponding to the re-driving time TM3.

As described above, the movable wall driving controller 572 performs control to drive the movable wall driving motor M1 within the driving time of the sheet conveying driving motor MS under the control of the sheet conveying driving circuit MS1. This makes it possible to prevent a driving sound of the movable wall driving motor M1 from being generated during a time period when the sheet conveying driving motor MS is stopped and the image forming operation of the image forming apparatus 1 is not being performed. Therefore, it is possible to suppress as much as possible from giving discomfort caused by the driving sound of the movable wall driving motor M1 to a user.

(About Toner Empty Control)

When a toner supply control al is repeated in accordance with the image forming operation of the image forming apparatus 1 and the toner in the storage space 37S of the container main body 37 continues to be replenished to the developing device 20, the movable wall 32 eventually reaches the final position in front of the toner discharge port 377.

When the toner falls from the toner discharge port 377 in accordance with the decrease of the toner in the accumulation portion 29 on the developing device 20 side in a state where the movable wall 32 is disposed at the final position, the draft surface of the toner contained in the storage space 37S is located below the specific region 37K1. In this case, the number of outputs of the H signal output from the container sensor 3S is less than the reference threshold value K, and the determination unit 571 outputs the first determination information J1 (time T13 in FIG. 27).

When the first determination information J1 is output from the determination unit 571, the signal controller 5721 transmits the drive permission signal S1 to the movable wall driving circuit M11 (time T13 in FIG. 27).

In a state in which the movable wall 32 is disposed at the final position, the female spiral portion 34J of the pressing member 34 is positioned at the movable wall stop portion 334, and the male spiral portion 333 and the female spiral portion 34J are disengaged from each other. For this reason, transmission of a moving force from the shaft 33 to the pressing member 34 is lost. Therefore, in a state in which the movable wall 32 is disposed at the final position, even if the movable wall driving circuit M11 drives the movable wall driving motor M1, the movable wall 32 is stopped at the final position without moving.

After sending the drive permission signal S1 to the movable wall driving circuit M11, the signal controller 5721 determines whether or not the first determination information J1 is continuously output a predetermined number of times from the determination unit 571 (step b11 in FIG. 26).

When the first determination information J1 is continuously output the predetermined number of times from the determination unit 571 (time T14, time T15, time T16 in FIG. 27), the signal controller 5721 determines that the toner is in the empty state in the storage space 37S. Then, the signal controller 5721 transmits a drive stop signal S5 to the movable wall driving circuit M11 in preference to the transmission of the drive permission signal S1 (step b12 in FIG. 26, time T16 in FIG. 27). The drive stop signal S5 is a control signal for stopping the drive control of the movable wall driving motor M1.

Upon receiving the drive stop signal S5 transmitted from the signal controller 5721, the movable wall driving circuit M11 stops driving the movable wall driving motor M1 (step b13 in FIG. 26). Note that, even if the first determination information J1 is output from the determination unit 571 after the transmission of the drive stop signal S5 to the movable wall driving circuit M11, the signal controller 5721 does not transmit the drive permission signal S1 until the attachment detector 574 detects mounting of a new toner container 30 to the developing device 20.

As described above, when the toner is in the empty state in the storage space 37S of the container main body 37, the movable wall driving controller 572 performs control to stop driving the movable wall driving motor M1. As a result, unnecessary driving of the movable wall driving motor M1 is restricted, and power consumption can be reduced.

When toner empty information is transmitted by the signal controller 5721, the image forming operation of the image forming apparatus 1 is temporarily stopped, and driving of the sheet conveying driving motor MS and the rotating body driving motor M2 is stopped (time T17 in FIG. 27).

Further, the signal controller 5721 transmits message information (the toner empty information) indicating that the toner is in the empty state in the storage space 37S to the display 12 via the communication unit 53. As a result, the toner empty information is displayed on the display 12. A user can confirm that the toner is in the empty state in the toner container 30 based on the toner empty information displayed on the display 12.

Although the embodiment of the present disclosure has been described above, the present disclosure is not limited thereto, and various modified embodiments can be adopted.

(1) In the above embodiment, a monochrome printer has been exemplified as the image forming apparatus 1, but the present disclosure is not limited thereto. In particular, when the image forming apparatus 1 is a tandem-type color printer, after the opening/closing cover 100C (see FIG. 2) of the image forming apparatus 1 is opened, the respective toner containers 30 corresponding to plural color toners may be mounted in the housing 101 so as to be adjacent from above.

(2) Further, in the above embodiment, the movable wall 32 has been described as moving from the lid 31 side to the right wall 375 side, but the present disclosure is not limited to this. The toner discharge port 377 may be opened to the lid 31 side, and the movable wall 32 may be moved from the right wall 375 side to the lid 31 side. Further, an opening position of the toner discharge port 377 is not limited to the above-described position. The toner discharge port 377 may be opened in a lowermost surface of the container main body 37 or may be opened at another position.

(3) In addition, the present disclosure is not limited to the one-component developing method, and the developing device 20 may adopt a two-component developing method.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

a developing device;

a developer container detachably mounted to the developing device, the developer container including a container main body having an internal space which extends in a first direction and contains a developer, the container main body being formed with a developer discharge port through which the developer is discharged toward the developing device, a movable wall which moves in the first direction in the internal space to convey the developer in the internal space toward the developer discharge port, and a rotating body which is disposed near the developer discharge port in the internal space and rotates around a shaft extending in the first direction;

a detection sensor which is disposed so as to face the container main body and is capable of detecting the developer;

a determination unit which, in a plurality of output signals output from the detection sensor at predetermined time intervals during one cycle which is one rotation of the rotating body, determines whether or not a number of outputs of a signal indicating that the developer has been detected is less than a reference threshold value, the determination unit outputting first determination information when the number of outputs is less than the reference threshold value, the determination unit outputting second determination information when the number of outputs is equal to or greater than the reference threshold value;

a movable wall driving unit including a first driving motor that generates a driving force for moving the movable wall and a first driving circuit that controls driving of the first driving motor; and a movable wall driving controller which is communicably connected to the first driving circuit and includes a signal controller for transmitting a control signal related to drive control of the first driving motor to the first driving circuit, wherein the signal controller transmits a drive permission signal, which is a control signal for permitting drive control of the first driving motor, when the first determination information is output from the determination unit, and transmits a drive non-permission signal, which is a control signal for not permitting drive control of the first driving motor, when the second determination information is output from the determination unit.

2. The image forming apparatus according to claim 1, further comprising:

a sheet conveying unit for conveying a sheet;

an image carrier for carrying a developer image to which the developer is supplied from the developing device and which is transferred to the sheet; and a sheet conveying driving unit including a second driving motor which generates a driving force for operating the sheet conveying unit and a second driving circuit which controls driving of the second driving motor, wherein the movable wall driving controller further includes a monitor which monitors control of the first driving circuit with respect to the first driving motor so that, when the signal controller transmits the drive permission signal to the first driving circuit, the first driving circuit controls driving of the first driving motor within a driving time of the second driving motor under the control of the second driving circuit.

3. The image forming apparatus according to claim 2, wherein the first driving circuit is configured to drive the first driving motor for a predetermined fixed time when receiving the drive permission signal from the signal controller, the monitor monitors a driving time of the first driving motor within the driving time of the second driving motor and calculates a difference value of each time when the driving time of the first driving motor is shorter than the fixed time, and when the difference value is calculated by the monitor, regardless of information output from the determination unit, the signal controller transmits a limited drive permission signal, which is a control signal for permitting drive control of the first driving motor for a time corresponding to the difference value within the driving time of the second driving motor, to the first driving circuit in preference to a transmission of the drive permission signal and the drive non-permission signal.

4. The image forming apparatus according to claim 1, wherein when the first determination information is continuously output a predetermined number of times from the determination unit after the transmission of the drive permission signal to the first driving circuit, the signal controller determines that the developer is in an empty state in the internal space, and transmits a drive stop signal, which is a control signal for stopping the drive control of the first driving motor, to the first driving circuit in preference to the transmission of the drive permission signal.

* * * * *